US007508371B2

(12) United States Patent
Kitani et al.

(10) Patent No.: US 7,508,371 B2
(45) Date of Patent: Mar. 24, 2009

(54) LIQUID CRYSTAL DISPLAY DEVICE

(75) Inventors: Masakatsu Kitani, Fukaya (JP); Masaki Miyatake, Kitaadachi-gun (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 567 days.

(21) Appl. No.: 10/899,084

(22) Filed: Jul. 27, 2004

(65) Prior Publication Data

US 2005/0035934 A1 Feb. 17, 2005

(30) Foreign Application Priority Data

Aug. 14, 2003 (JP) ..... 2003-293318
Feb. 17, 2004 (JP) ..... 2004-040128

(51) Int. Cl.
*G09G 3/36* (2006.01)

(52) U.S. Cl. ..... 345/100; 345/87

(58) Field of Classification Search ..... 345/79, 345/87, 96, 98, 99, 100, 209
See application file for complete search history.

(56) References Cited

U.S. PATENT DOCUMENTS 5,784,042 A * 7/1998 Ono et al. ..... 345/94
6,628,261 B1 * 9/2003 Sato et al. ..... 345/99
2003/0058375 A1 * 3/2003 Moon et al. ..... 349/42
2003/0107544 A1 * 6/2003 Edwards ..... 345/96
2004/0145555 A1 * 7/2004 Tai et al. ..... 345/96
2004/0207593 A1 * 10/2004 Ha et al. ..... 345/100

FOREIGN PATENT DOCUMENTS

EP 1 293 957 A2 3/2003
EP 1293957 A2 * 3/2003
JP 2001-324963 11/2001
JP 2001324963 A * 11/2001
JP 2002-312255 10/2002

* cited by examiner

*Primary Examiner*—Amare Mengistu
*Assistant Examiner*—Jennifer Zubajlo
(74) *Attorney, Agent, or Firm*—Oblon, Spivak, McClelland, Maier & Neustadt, P.C.

(57) ABSTRACT

In order to reduce the scale of drive ICs and to prevent uneven display in signal line selective drive, in this liquid crystal display device, for each group in which one video output line corresponds to N signal lines, the signal line is switched and connected to the video output line via an analog switch ASW. Thus, the number of the video output lines is reduced to 1/N. Moreover, as to an Lth scan line, for each of the groups, a signal line to which a video signal having its polarity inverted between an L-1th scan line and the Lth scan line is supplied is selected first and a signal line to which a video signal having its polarity not inverted is supplied is selected later. Thus, a video signal in which a polarity is not inverted and no potential change occurs is supplied to the signal line later.

3 Claims, 39 Drawing Sheets

FIG. 9

(VIDEO SIGNAL D1) (VIDEO SIGNAL D2)

| | R1 | G1 | B1 | R2 | G2 | B2 | R3 | G3 |
|---|---|---|---|---|---|---|---|---|
| 1 LINE | 2 | 3 | -1 | -4 | 1 | 4 | -2 | -3 |
| 2 LINE | 4 | -2 | -3 | 1 | 3 | -1 | -4 | 2 |
| 3 LINE | -2 | -3 | 1 | 4 | -1 | -4 | 2 | 3 |
| 4 LINE | -4 | 2 | 3 | -1 | -3 | 1 | 4 | -2 |

| | R1 | G1 | B1 | R2 | G2 | B2 | R3 | G3 |
|---|---|---|---|---|---|---|---|---|
| 1 LINE | A | D | B | C | B | C | A | D |
| 2 LINE | C | A | D | A | D | A | C | A |
| 3 LINE | A | D | B | C | B | C | A | D |
| 4 LINE | C | A | D | A | D | A | C | A |

FIG. 10

(VIDEO SIGNAL D1) (VIDEO SIGNAL D2)

| | R1 | G1 | B1 | R2 | G2 | B2 | R3 | G3 |
|---|---|---|---|---|---|---|---|---|
| 1 LINE | 2 | 3 | -1 | -4 | 1 | 4 | -2 | -3 |
| 2 LINE | 3 | -1 | -4 | 2 | 4 | -2 | -3 | 1 |
| 3 LINE | -1 | -4 | 2 | 3 | -2 | -3 | 1 | 4 |
| 4 LINE | -4 | 2 | 3 | -1 | -3 | 1 | 4 | -2 |

| | R1 | G1 | B1 | R2 | G2 | B2 | R3 | G3 |
|---|---|---|---|---|---|---|---|---|
| 1 LINE | A | D | B | C | B | C | A | D |
| 2 LINE | D | B | C | A | C | A | D | B |
| 3 LINE | B | C | A | D | A | D | B | C |
| 4 LINE | C | A | D | B | D | B | C | A |

FIG. 12

<n FRAME>

| | | | | | | | | | | | | | | | | | | | | | | | | | |
|---|---|---|---|---|---|---|---|---|---|---|---|---|---|---|---|---|---|---|---|---|---|---|---|---|---|
| POSITIVE | 7 | 7 | 7 | 7 | 9 | 9 | 9 | 9 | 7 | 7 | 7 | 7 | 9 | 9 | 9 | 9 | 7 | 7 | 7 | 7 | 9 | 9 | 9 | 9 | 7 |
| NEGATIVE | 9 | 9 | 9 | 9 | 7 | 7 | 7 | 7 | 9 | 9 | 9 | 9 | 7 | 7 | 7 | 7 | 9 | 9 | 9 | 9 | 7 | 7 | 7 | 7 | 9 |
| Sig_No | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| | R1 | G1 | B1 | R2 | G2 | B2 | R3 | G3 | B3 | R4 | G4 | B4 | R5 | G5 | B5 | R6 | G6 | B6 | R7 | G7 | B7 | R8 | G8 | B8 | R9 |
| a | 2 | 3 | -1 | -4 | 1 | 4 | -2 | -3 | 2 | 3 | -1 | -4 | 1 | 4 | -2 | -3 | 2 | 3 | -1 | -4 | 1 | 4 | -2 | -3 | 2 |
| b | 3 | -1 | -4 | 2 | 4 | -2 | -3 | 1 | 3 | -1 | -4 | 2 | 4 | -2 | -3 | 1 | 3 | -1 | -4 | 2 | 4 | -2 | -3 | 1 | 3 |
| c | -1 | -4 | 2 | 3 | -2 | -3 | 1 | 4 | -1 | -4 | 2 | 3 | -2 | -3 | 1 | 4 | -1 | -4 | 2 | 3 | -2 | -3 | 1 | 4 | -1 |
| d | -4 | 2 | 3 | -1 | -3 | 1 | 4 | -2 | -4 | 2 | 3 | -1 | -3 | 1 | 4 | -2 | -4 | 2 | 3 | -1 | -3 | 1 | 4 | -2 | -4 |
| e | 2 | 3 | -1 | -4 | 1 | 4 | -2 | -3 | 2 | 3 | -1 | -4 | 1 | 4 | -2 | -3 | 2 | 3 | -1 | -4 | 1 | 4 | -2 | -3 | 2 |

FIG. 13

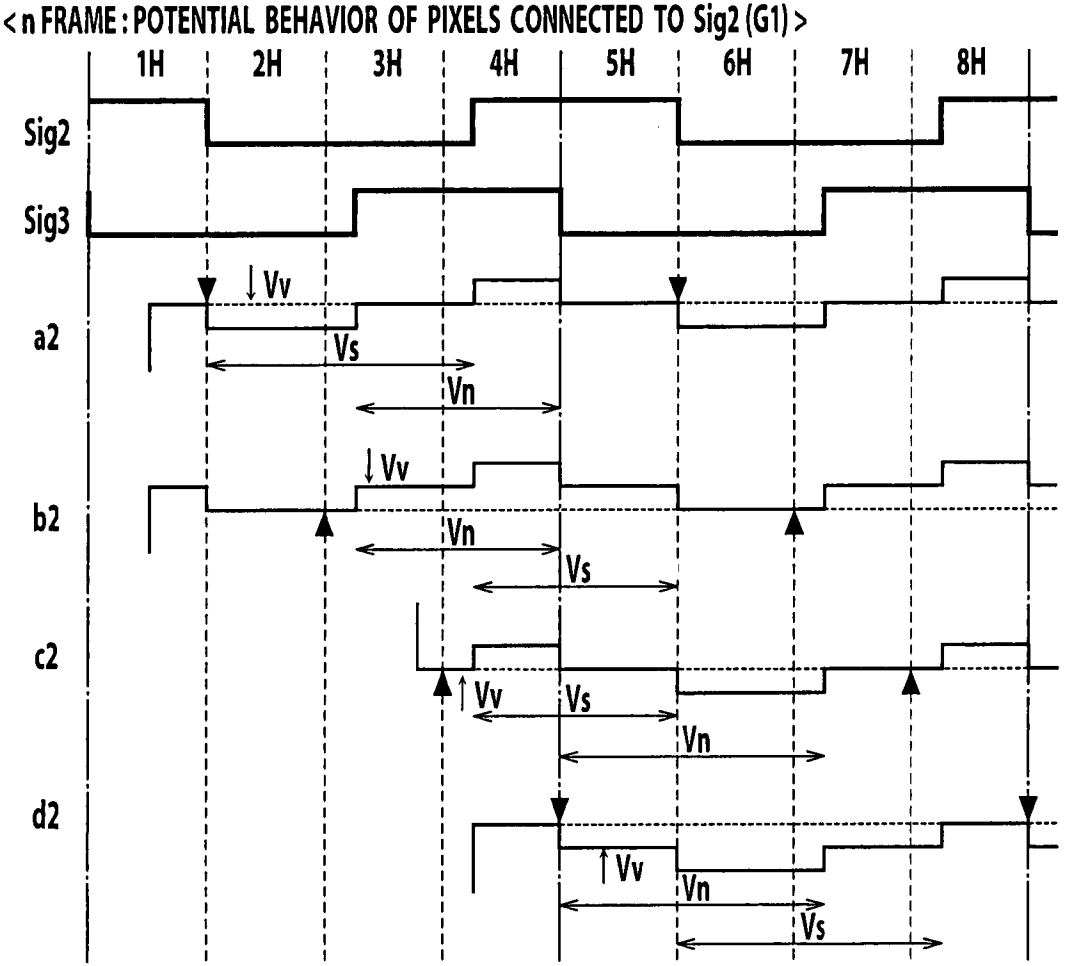

<EFFECTIVE POTENTIALS>

(Vp_a2) eff = (Vp.a2 - 9/16 × Vs + 7/16 × Vn-Vv) - Vcom
=(Vp.a2 - Vcom) + 7/16 × Vn- 9/16 × Vs - Vv (Vp_b2) eff = Vcom - (Vp.b2 + 7/16 × Vn + 7/16 × Vs-Vv)
=(Vcom - Vp.b2) - 7/16 × Vn- 7/16 × Vs + Vv (Vp_c2) eff = Vcom - (Vp.c2 + 7/16 × Vs - 9/16 × Vn +Vv)
= (Vcom - Vp.c2) + 9/16 × Vn- 7/16 × Vs - Vv (Vp_d2) eff = (Vp.d2 - 9/16 × Vn - 9/16 × Vs + Vv) - Vcom
= (Vp.d2 - Vcom) - 9/16 × Vn- 9/16 × Vs + Vv

<EFFECTIVE POTENTIALS OF THE PIXELS POSITIONED ABOVE AND BELOW> dVa_b = 7/8 × Vn-1/8 × Vs-2 × Vv dVb_c = Vn - 2 × Vv dVc_d = 9/8 × Vn+1/8 × Vs -2 × Vv dVd_e = Vn - 2 × Vv

FIG. 14

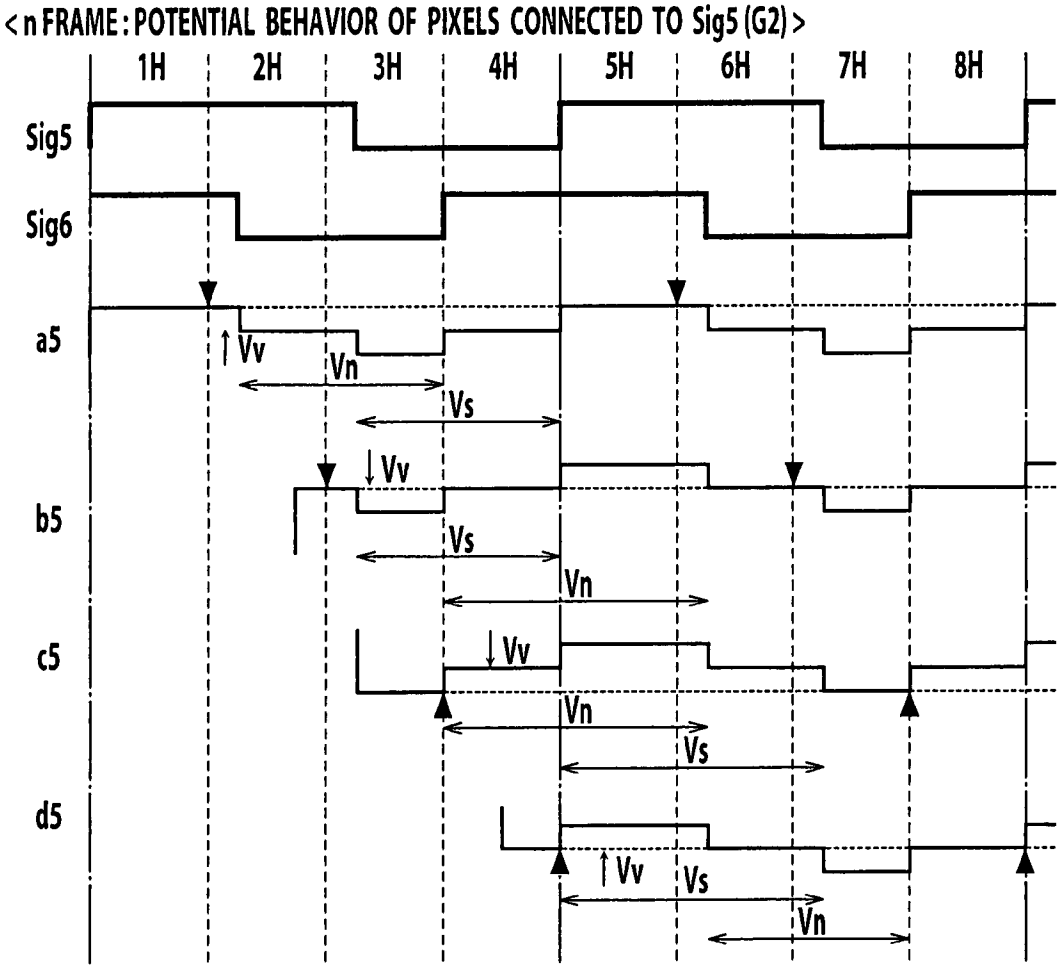

<EFFECTIVE POTENTIALS>

(Vp_a5) eff = (Vp.a5 - 7/16 × Vn - 7/16 × Vs + Vv) - Vcom
= (Vp.a5 - Vcom) - 7/16 × Vn - 7/16 × Vs + Vv (Vp_b5) eff = (Vp.b5 - 7/16 × Vs + 9/16 × Vn - Vv) - Vcom
= (Vp.b5 - Vcom) + 9/16 × Vn - 7/16 × Vs - Vv (Vp_c5) eff = Vcom - (Vp.c5 + 9/16 × Vn + 9/16 × Vs - Vv)
= (Vcom - Vp.c5) - 9/16 × Vn - 9/16 × Vs + Vv (Vp_d5) eff = Vcom - (Vp.d5 + 9/16 × Vs - 7/16 × Vn + Vv)
= (Vcom - Vp.d5) + 7/16 × Vn - 9/16 × Vs - Vv

<EFFECTIVE POTENTIALS OF THE PIXELS POSITIONED ABOVE AND BELOW> dVa_b = Vn - 2 × Vv dVb_c = 9/8 × Vn + 1/8 × Vs - 2 × Vv dVc_d = Vn - 2 × Vv dVd_e = 7/8 × Vn - 1/8 × Vs - 2 × Vv

FIG. 15

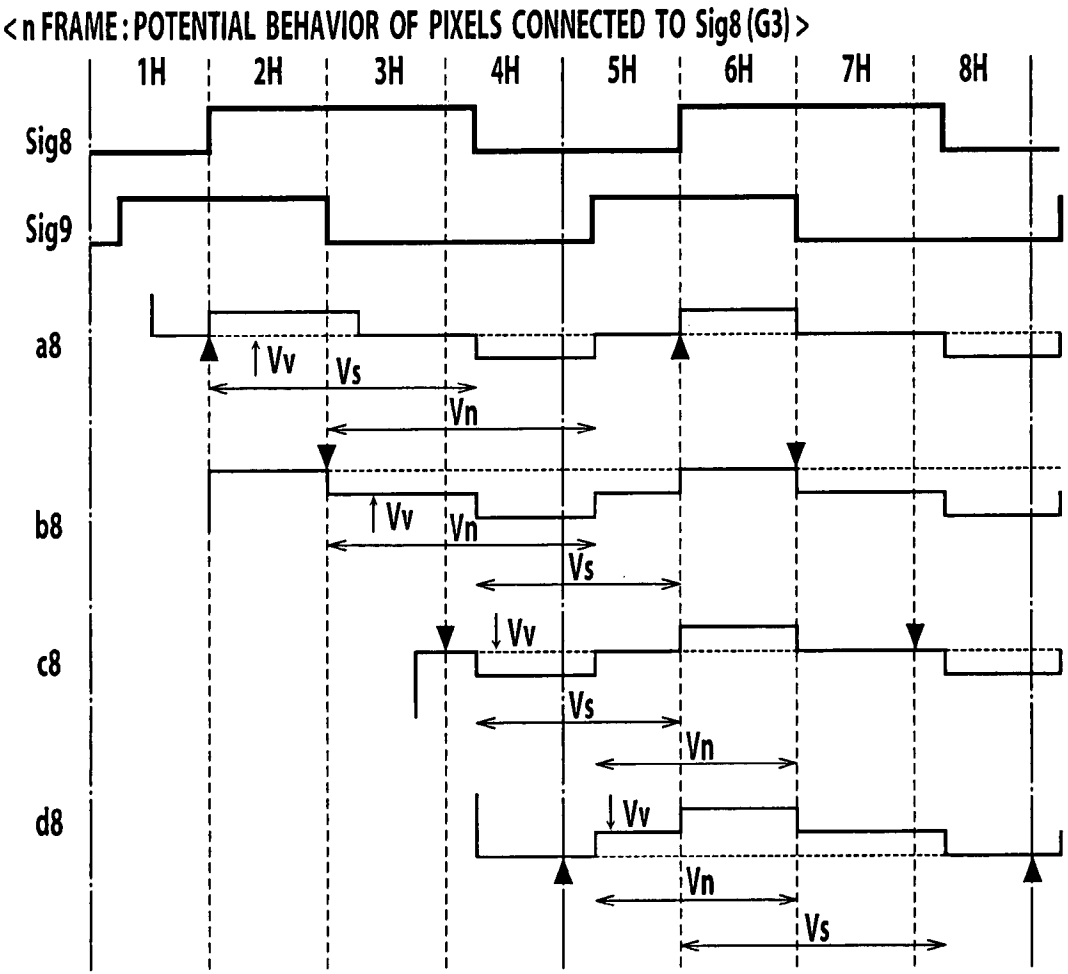

<EFFECTIVE POTENTIALS>

(Vp_a8) eff = Vcom - (Vp.a8 + 9/16 × Vs + 9/16 × Vn + Vv)
= (Vcom - Vp.a8) + 9/16 × Vn - 9/16 × Vs - Vv (Vp_b8) eff = (Vp.b8 - 9/16 × Vn - 7/16 × Vs + Vv) - Vcom
= (Vp.b8 - Vcom) - 9/16 × Vn - 7/16 × Vs + Vv (Vp_c8) eff = (Vp.c8 - 7/16 × Vs + 7/16 × Vn - Vv) - Vcom
= (Vp.c8 - Vcom) + 7/16 × Vn - 7/16 × Vs - Vv (Vp_d8) eff = Vcom - (Vp.d8 + 7/16 × Vn + 9/16 × Vs - Vv)
= (Vcom - Vp.d8) - 7/16 × Vn - 9/16 × Vs + Vv

<EFFECTIVE POTENTIALS OF THE PIXELS POSITIONED ABOVE AND BELOW> dVa_b = 9/8 × Vn - 1/8 × Vs - 2 × Vv dVb_c = Vn - 2 × Vv dVc_d = 7/8 × Vn + 1/8 × Vs - 2 × Vv dVd_e = Vn - 2 × Vv

FIG. 16

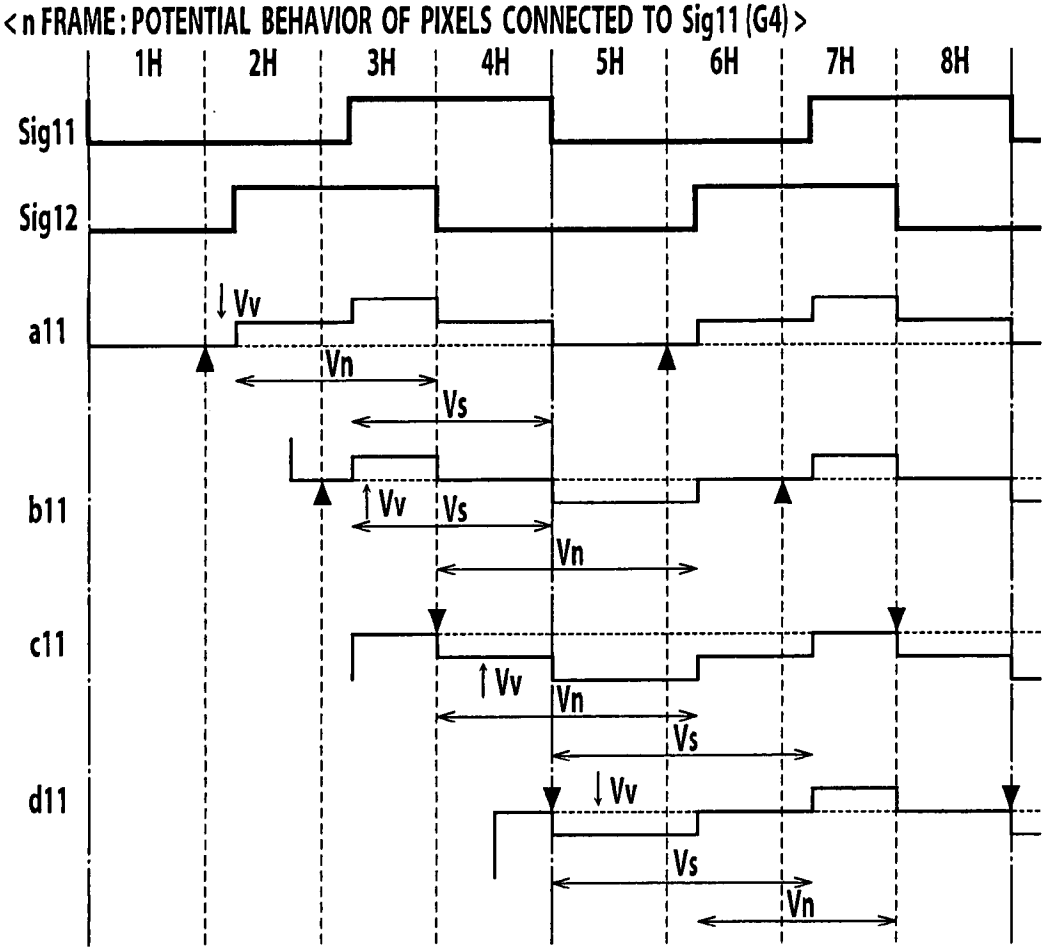

<EFFECTIVE POTENTIALS>

(Vp_a11) eff = Vcom - (Vp.a11 + 7/16 × Vn + 7/16 × Vs - Vv)
= (Vcom - Vp.a11) - 7/16 × Vn - 7/16 × Vs + Vv (Vp_d11) eff = Vcom - (Vp.d11 + 7/16 × Vs - 9/16 × Vn + Vv)
= (Vcom - Vp.b11) + 9/16 × Vn - 7/16 × Vs - Vv (Vp_c11) eff = (Vp.c11 - 9/16 × Vn - 9/16 × Vs + Vv) - Vcom
= (Vp.c11 - Vcom) - 9/16 × Vn - 9/16 × Vs + Vv (Vp_d11) eff = (Vp.d11 - 9/16 × Vs + 7/16 × Vn - Vv) - Vcom
= (Vp.d11 - Vcom) + 7/16 × Vn - 9/16 × Vs - Vv

<EFFECTIVE POTENTIALS OF THE PIXELS POSITIONED ABOVE AND BELOW> dVa_b = Vn - 2 × Vv dVb_c = 9/8 × Vn + 1/8 × Vs - 2 × Vv dVc_d = Vn - 2 × Vv dVd_e = 7/8 × Vn - 1/8 × Vs - 2 × Vv

FIG. 20

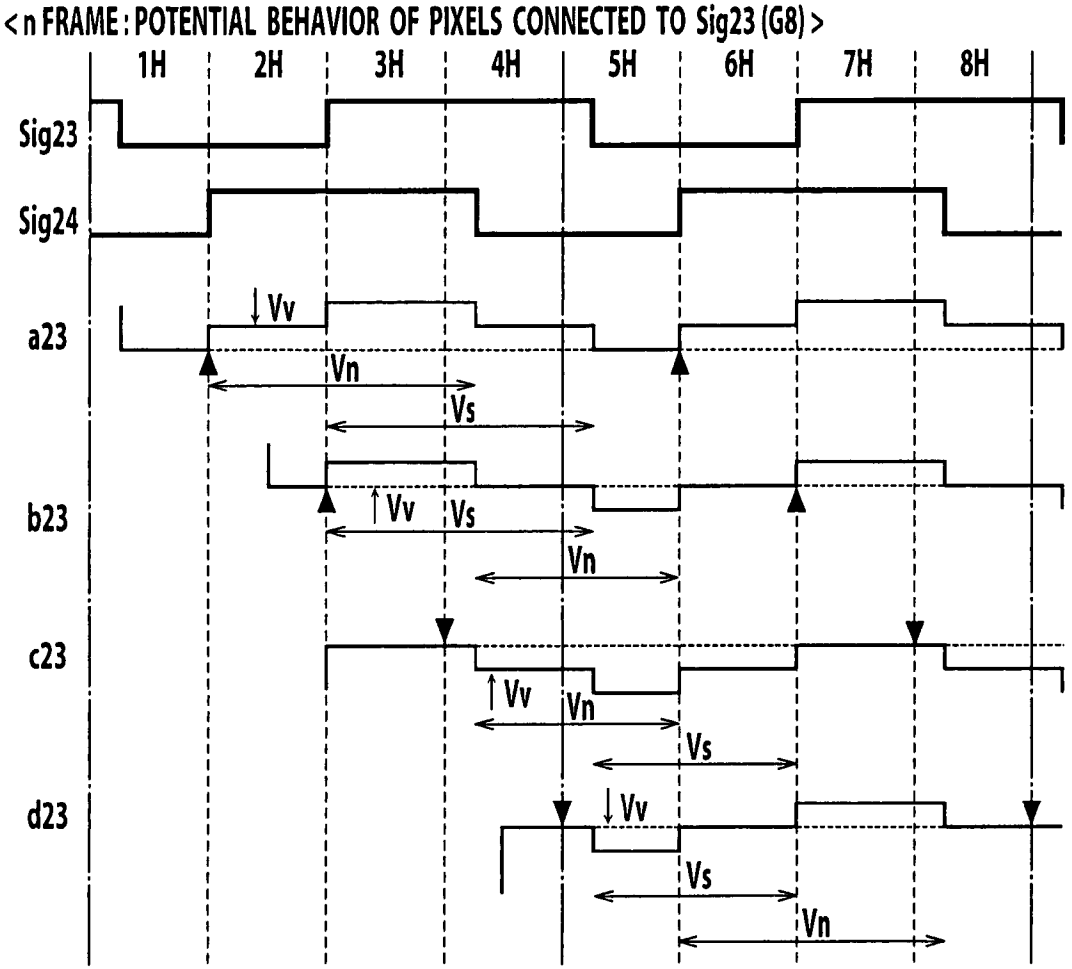

<EFFECTIVE POTENTIALS>

(Vp_a23) eff = Vcom - (Vp.a23 + 9/16 × Vn + 9/16 × Vs - Vv)
= (Vcom - Vp.a23) - 9/16 × Vn - 9/16 × Vs + Vv (Vp_b23) eff = Vcom - (Vp.b23 + 9/16 × Vs - 7/16 × Vn + Vv)
= (Vcom - Vp.b23) + 7/16 × Vn - 9/16 × Vs - Vv (Vp_c23) eff = (Vp.c23 - 7/16 × Vn - 7/16 × Vs + Vv) - Vcom
= (Vp.c23 - Vcom) - 7/16 × Vn - 7/16 × Vs + Vv (Vp_d23) eff = (Vp.d23 - 7/16 × Vs + 9/16 × Vn - Vv) - Vcom
= (Vp.d23 - Vcom) + 9/16 × Vn - 7/16 × Vs - Vv

<EFFECTIVE POTENTIALS OF THE PIXELS POSITIONED ABOVE AND BELOW> dVa_b = Vn - 2 × Vv dVb_c = 7/8 × Vn - 1/8 × Vs - 2 × Vv dVc_d = Vn - 2 × Vv dVd_e = 9/8 × Vn + 1/8 × Vs - 2 × Vv

FIG. 21

<n+1 FRAME>

| | | | | | | | | | | | | | | | | | | | | | | | | | |
|---|---|---|---|---|---|---|---|---|---|---|---|---|---|---|---|---|---|---|---|---|---|---|---|---|---|
| POSITIVE | 7 | 7 | 7 | 7 | 9 | 9 | 9 | 9 | 7 | 7 | 7 | 7 | 9 | 9 | 9 | 9 | 7 | 7 | 7 | 7 | 9 | 9 | 9 | 9 | 7 |
| NEGATIVE | 9 | 9 | 9 | 9 | 7 | 7 | 7 | 7 | 9 | 9 | 9 | 9 | 7 | 7 | 7 | 7 | 9 | 9 | 9 | 9 | 7 | 7 | 7 | 7 | 9 |
| Sig_No | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| | R1 | G1 | B1 | R2 | G2 | B2 | R3 | G3 | B3 | R4 | G4 | B4 | R5 | G5 | B5 | R6 | G6 | B6 | R7 | G7 | B7 | R8 | G8 | B8 | R9 |
| a | -2 | -3 | 1 | 4 | -1 | -4 | 2 | 3 | -2 | -3 | 1 | 4 | -1 | -4 | 2 | 3 | -2 | -3 | 1 | 4 | -1 | -4 | 2 | 3 | -2 |
| b | -3 | 1 | 4 | -2 | -4 | 2 | 3 | -1 | -3 | 1 | 4 | -2 | -4 | 2 | 3 | -1 | -3 | 1 | 4 | -2 | -4 | 2 | 3 | -1 | -3 |
| c | 1 | 4 | -2 | -3 | 2 | 3 | -1 | -4 | 1 | 4 | -2 | -3 | 2 | 3 | -1 | -4 | 1 | 4 | -2 | -3 | 2 | 3 | -1 | -4 | 1 |
| d | 4 | -2 | -3 | 1 | 3 | -1 | -4 | 2 | 4 | -2 | -3 | 1 | 3 | -1 | -4 | 2 | 4 | -2 | -3 | 1 | 3 | -1 | -4 | 2 | 4 |
| e | -2 | -3 | 1 | 4 | -1 | -4 | 2 | 3 | -2 | -3 | 1 | 4 | -1 | -4 | 2 | 3 | -2 | -3 | 1 | 4 | -1 | -4 | 2 | 3 | -2 |

FIG. 27

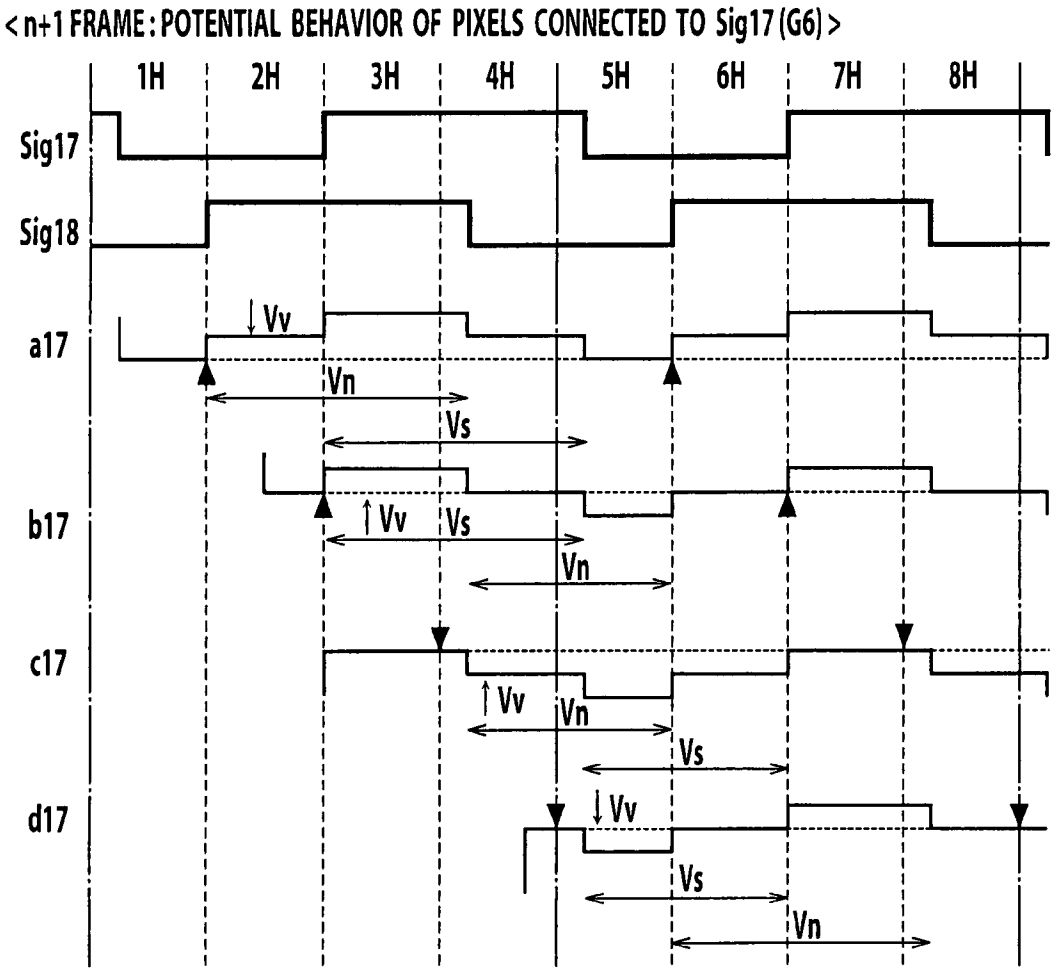

<EFFECTIVE POTENTIALS>

(Vp_a17) eff = Vcom - (Vp.a17 + 9/16 × Vn + 9/16 × Vs - Vv)
= (Vcom - Vp.a17) - 9/16 × Vn - 9/16 × Vs + Vv (Vp_b17) eff = Vcom - (Vp.b17 + 9/16 × Vs - 7/16 × Vn + Vv)
= (Vcom - Vp.b17) + 7/16 × Vn - 9/16 × Vs - Vv (Vp_c17) eff = (Vp.c17 - 7/16 × Vn - 7/16 × Vs + Vv) - Vcom
= (Vp.c17 - Vcom) - 7/16 × Vn - 7/16 × Vs + Vv (Vp_d17) eff = (Vp.d17 - 7/16 × Vs + 9/16 × Vn - Vv) - Vcom
= (Vp.d17 - Vcom) + 9/16 × Vn - 7/16 × Vs - Vv

<EFFECTIVE POTENTIALS OF THE PIXELS POSITIONED ABOVE AND BELOW> dVa_b = Vn - 2 × Vv dVb_c = 7/8 × Vn - 1/8 × Vs - 2 × Vv dVc_d = Vn - 2 × Vv dVd_e = 9/8 × Vn + 1/8 × Vs - 2 × Vv

FIG. 28

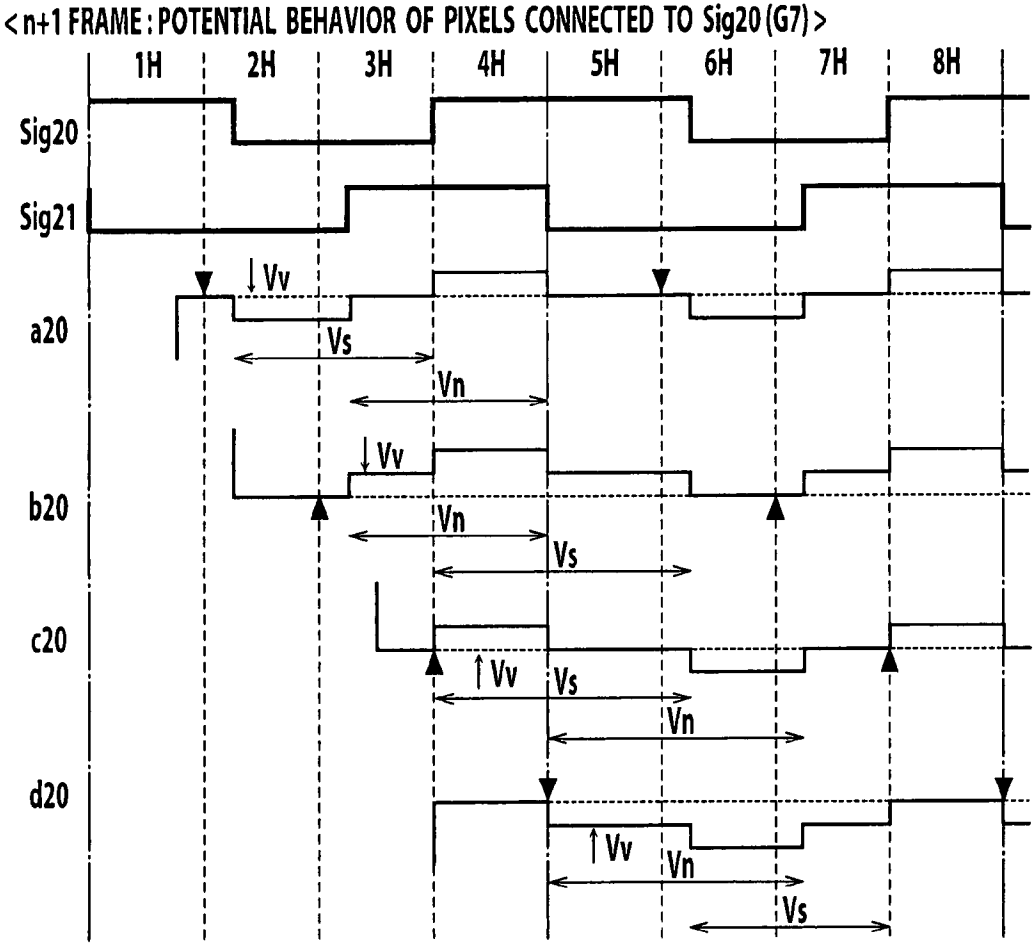

< EFFECTIVE POTENTIALS >

(Vp_a20) eff = (Vp.a20 - 7/16 × Vs + 7/16 × Vn - Vv) - Vcom
=(Vp.a20 - Vcom) + 7/16 × Vn - 7/16 × Vs - Vv (Vp_b20) eff = Vcom - (Vp.b20 + 7/16 × Vn + 9/16 × Vs - Vv)
=(Vcom - Vp.b20) - 7/16 × Vn - 9/16 × Vs + Vv (Vp_c20) eff = Vcom - (Vp.c20 + 9/16 × Vs - 9/16 × Vn + Vv)
= (Vcom - Vp.c20) + 9/16 × Vn - 9/16 × Vs - Vv (Vp_d20) eff = (Vp.d20 - 9/16 × Vn - 7/16 × Vs + Vv) - Vcom
= (Vp.d20 - Vcom) - 9/16 × Vn - 7/16 × Vs + Vv

< EFFECTIVE POTENTIALS OF THE PIXELS POSITIONED ABOVE AND BELOW > dVa_b = 7/8 × Vn+1/8 × Vs-2 × Vv dVb_c = Vn - 2 × Vv dVc_d = 9/8 × Vn-1/8 × Vs-2 × Vv dVd_e = Vn - 2 × Vv

FIG. 29

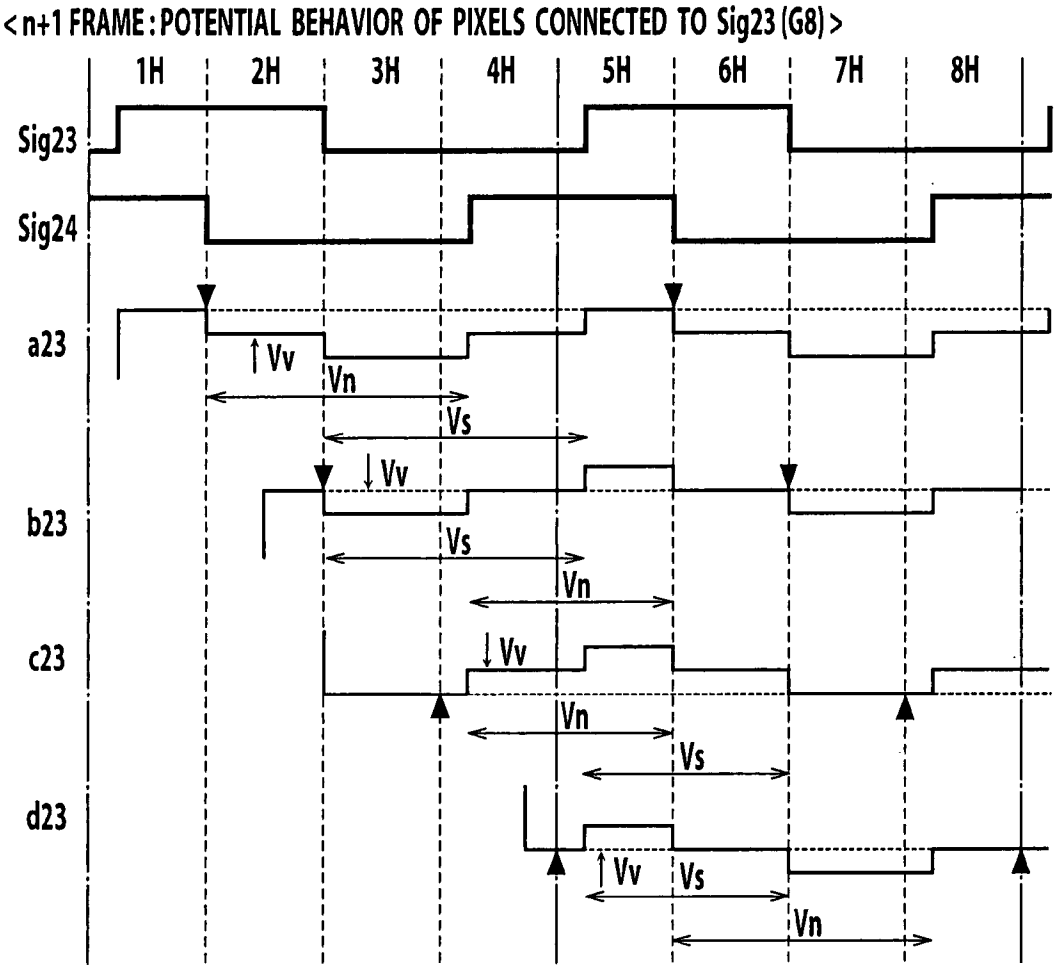

< EFFECTIVE POTENTIALS >

(Vp_a23) eff = (Vp.a23 - 9/16 × Vn - 9/16 × Vs + Vv) - Vcom
= (Vp.a23 - Vcom) - 9/16 × Vn - 9/16 × Vs + Vv (Vp_b23) eff = (Vp.b23 - 9/16 × Vs + 7/16 × Vn - Vv) - Vcom
= (Vp.b23 - Vcom) + 7/16 × Vn - 9/16 × Vs - Vv (Vp_c23) eff = Vcom - (Vp.c23 + 7/16 × Vn + 7/16 × Vs - Vv)
= (Vcom - Vp.c23) - 7/16 × Vn - 7/16 × Vs + Vv (Vp_d23) eff = Vcom - (Vp.d23 + 7/16 × Vs - 9/16 × Vn + Vv)
= (Vcom - Vp.d23) + 9/16 × Vn - 7/16 × Vs - Vv

< EFFECTIVE POTENTIALS OF THE PIXELS POSITIONED ABOVE AND BELOW > dVa_b = Vn - 2 × Vv dVb_c = 7/8 × Vn-1/8 × Vs-2 × Vv dVc_d = Vn - 2 × Vv dVd_e = 9/8 × Vn+1/8 × Vs-2 × Vv

FIG. 30

<n+1 FRAME>

| | | | | | | | | | | | | | | | | | | | | | | | | | |
|---|---|---|---|---|---|---|---|---|---|---|---|---|---|---|---|---|---|---|---|---|---|---|---|---|---|
| POSITIVE | 7 | 7 | 7 | 7 | 9 | 9 | 9 | 9 | 7 | 7 | 7 | 7 | 9 | 9 | 9 | 9 | 7 | 7 | 7 | 7 | 9 | 9 | 9 | 9 | 7 |
| NEGATIVE | 9 | 9 | 9 | 9 | 7 | 7 | 7 | 7 | 9 | 9 | 9 | 9 | 7 | 7 | 7 | 7 | 9 | 9 | 9 | 9 | 7 | 7 | 7 | 7 | 9 |
| Sig_No | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
| | R1 | G1 | B1 | R2 | G2 | B2 | R3 | G3 | B3 | R4 | G4 | B4 | R5 | G5 | B5 | R6 | G6 | B6 | R7 | G7 | B7 | R8 | G8 | B8 | R9 |
| a | -1 | -4 | 2 | 3 | -2 | -3 | 1 | 4 | -1 | -4 | 2 | 3 | -2 | -3 | 1 | 4 | -1 | -4 | 2 | 3 | -2 | -3 | 1 | 4 | -1 |
| b | -4 | 2 | 3 | -1 | -3 | 1 | 4 | -2 | -4 | 2 | 3 | -1 | -3 | 1 | 4 | -2 | -4 | 2 | 3 | -1 | -3 | 1 | 4 | -2 | -4 |
| c | 2 | 3 | -1 | -4 | 1 | 4 | -2 | -3 | 2 | 3 | -1 | -4 | 1 | 4 | -2 | -3 | 2 | 3 | -1 | -4 | 1 | 4 | -2 | -3 | 2 |
| d | 3 | -1 | -4 | 2 | 4 | -2 | -3 | 1 | 3 | -1 | -4 | 2 | 4 | -2 | -3 | 1 | 3 | -1 | -4 | 2 | 4 | -2 | -3 | 1 | 3 |
| e | -1 | -4 | 2 | 3 | -2 | -3 | 1 | 4 | -1 | -4 | 2 | 3 | -2 | -3 | 1 | 4 | -1 | -4 | 2 | 3 | -2 | -3 | 1 | 4 | -1 |

FIG. 31

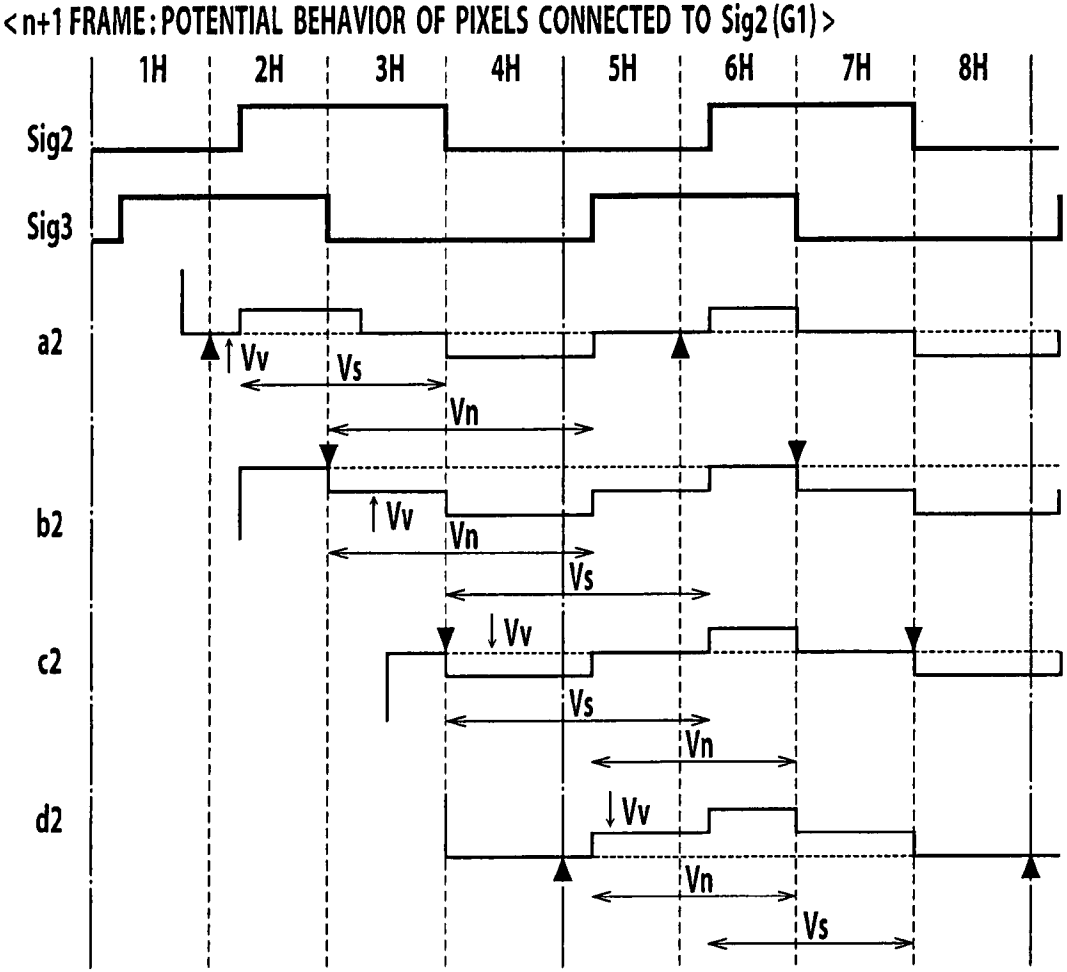

<EFFECTIVE POTENTIALS>

(Vp_a2) eff = Vcom - (Vp.a2 + 7/16 × Vs - 9/16 × Vn + Vv)
= (Vcom - Vp.a2) + 9/16 × Vn - 7/16 × Vs - Vv (Vp_b2) eff = (Vp.b2 - 9/16 × Vn - 9/16 × Vs + Vv) - Vcom
= (Vp.b2 - Vcom) - 9/16 × Vn - 9/16 × Vs + Vv (Vp_c2) eff = (Vp.c2 - 9/16 × Vs + 7/16 × Vn - Vv) - Vcom
= (Vp.c2 - Vcom) + 7/16 × Vn - 9/16 × Vs - Vv (Vp_d2) eff = Vcom - (Vp.d2 + 7/16 × Vn + 7/16 × Vs - Vv)
= (Vcom - Vp.d2) - 7/16 × Vn - 7/16 × Vs + Vv

<EFFECTIVE POTENTIALS OF THE PIXELS POSITIONED ABOVE AND BELOW> dVa_b = 9/8 × Vn+1/8 × Vs-2 × Vv dVb_c = Vn - 2 × Vv dVc_d = 7/8 × Vn-1/8 × Vs-2 × Vv dVd_e = Vn - 2 × Vv

FIG. 33

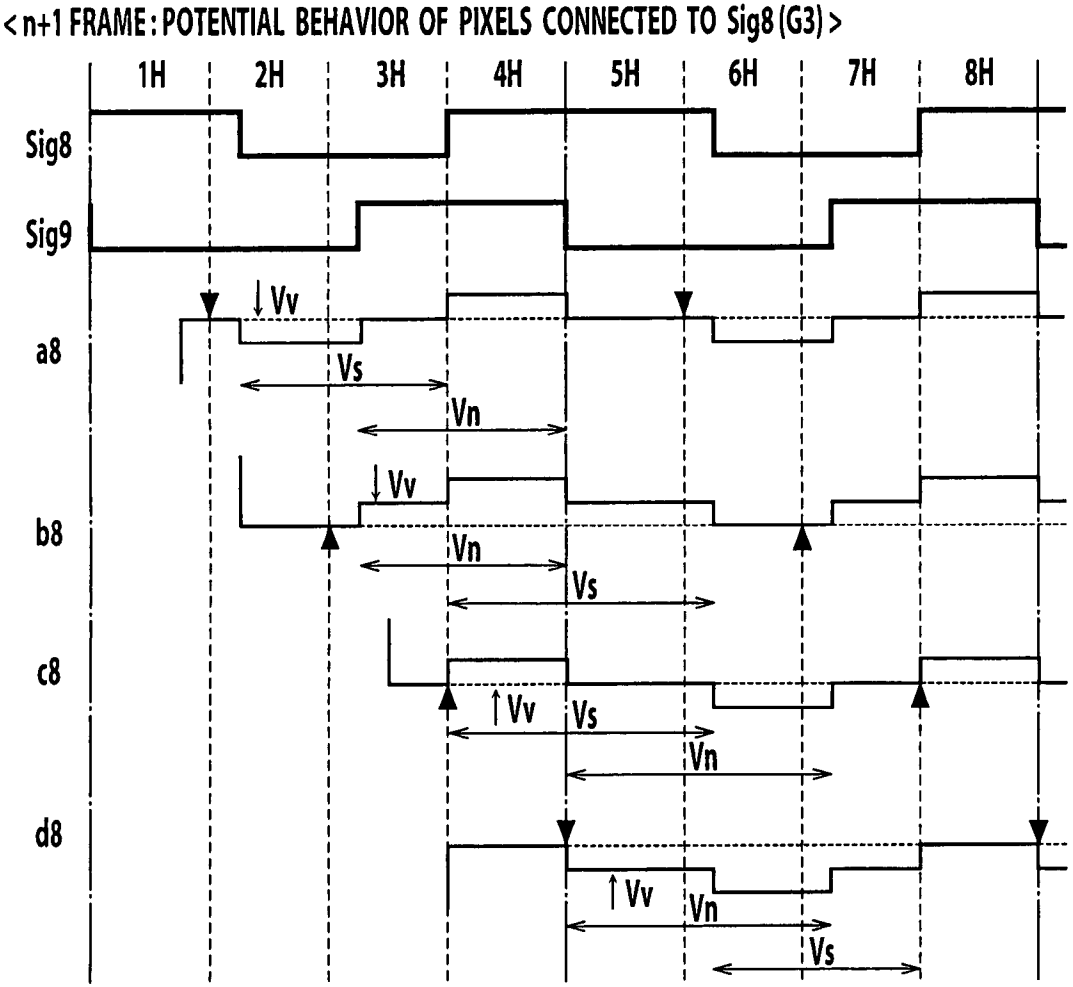

<EFFECTIVE POTENTIALS>

(Vp_a8) eff = (Vp.a8 - 7/16 × Vs + 7/16 × Vn - Vv) - Vcom
= (Vp.a8 - Vcom) + 7/16 × Vn - 7/16 × Vs - Vv (Vp_b8) eff = Vcom - (Vp.b8 + 7/16 × Vn + 9/16 × Vs - Vv)
= (Vcom - Vp.b8) - 7/16 × Vn - 9/16 × Vs + Vv (Vp_c8) eff = Vcom - (Vp.c8 + 9/16 × Vs - 9/16 × Vn + Vv)
= (Vcom - Vp.c8) + 9/16 × Vn - 9/16 × Vs - Vv (Vp_d8) eff = (Vp.d8 - 9/16 × Vn - 7/16 × Vs + Vv) - Vcom
= (Vp.d8 - Vcom) - 9/16 × Vn - 7/16 × Vs + Vv

<EFFECTIVE POTENTIALS OF THE PIXELS POSITIONED ABOVE AND BELOW> dVa_b = 7/8 × Vn + 1/8 × Vs - 2 × Vv dVb_c = Vn - 2 × Vv dVc_d = 9/8 × Vn - 1/8 × Vs - 2 × Vv dVd_e = Vn - 2 × Vv

FIG. 34

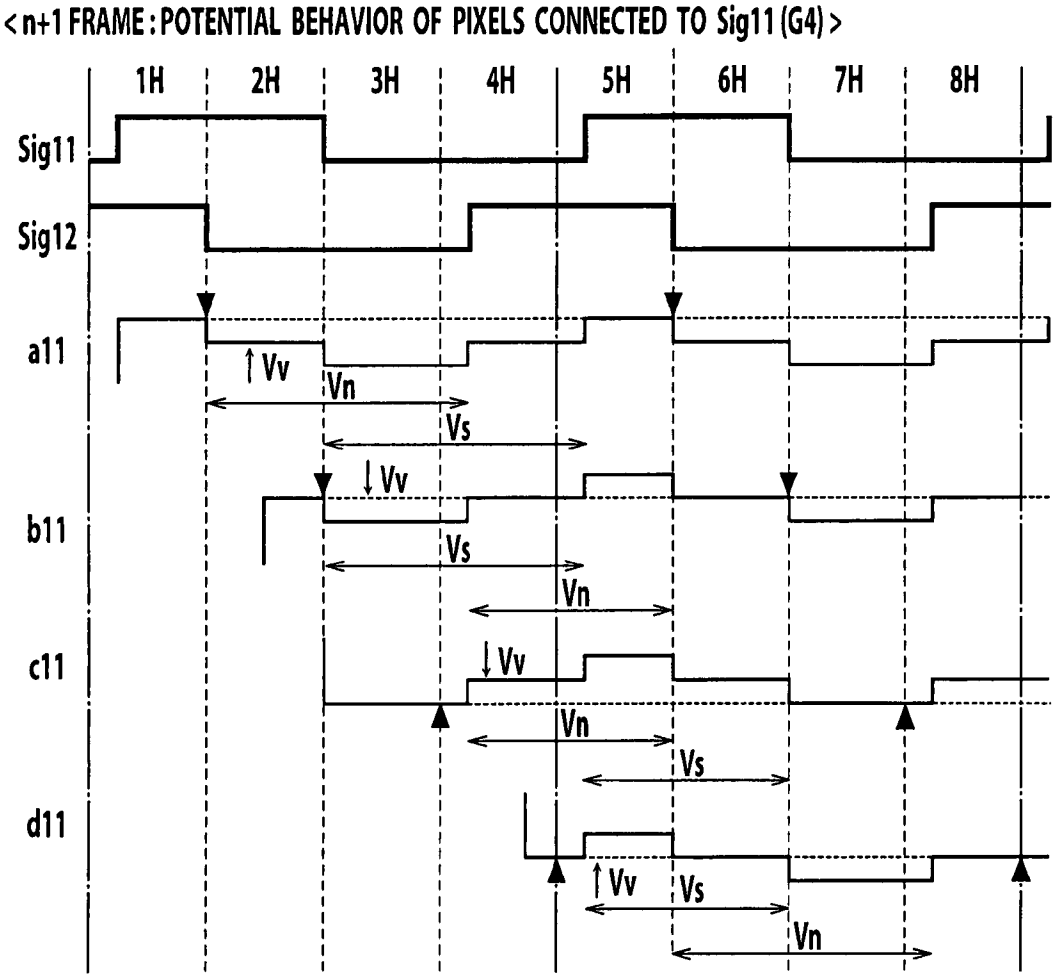

<EFFECTIVE POTENTIALS>

(Vp_a11) eff = (Vp.a11 - 9/16 × Vn - 9/16 × Vs + Vv) - Vcom
= (Vp.a11 - Vcom) - 9/16 × Vn - 9/16 × Vs + Vv (Vp_b11) eff = (Vp.b11 - 9/16 × Vs + 7/16 × Vn - Vv) - Vcom
= (Vp.b11 - Vcom) + 7/16 × Vn - 9/16 × Vs - Vv (Vp_c11) eff = Vcom - (Vp.c11 + 7/16 × Vn + 7/16 × Vs - Vv)
= (Vcom - Vp.c11) - 7/16 × Vn - 7/16 × Vs + Vv (Vp_d11) eff = Vcom - (Vp.d11 + 7/16 × Vs - 9/16 × Vn + Vv)
= (Vcom - Vp.d11) + 9/16 × Vn - 7/16 × Vs - Vv

<EFFECTIVE POTENTIALS OF THE PIXELS POSITIONED ABOVE AND BELOW> dVa_b = Vn - 2 × Vv dVb_c = 7/8 × Vn-1/8 × Vs-2 × Vv dVc_d = Vn - 2 × Vv dVd_e = 9/8 × Vn+1/8 × Vs-2 × Vv

FIG. 35

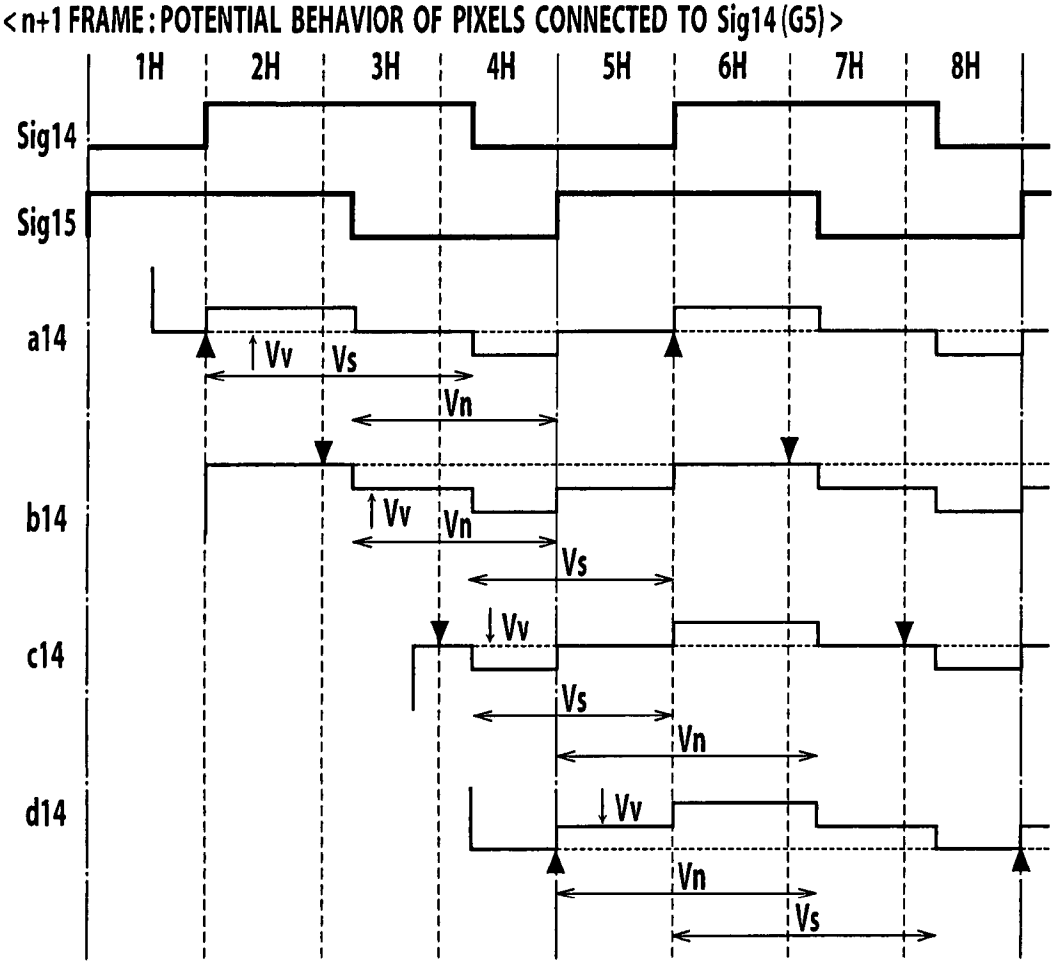

<EFFECTIVE POTENTIALS>

(Vp_a14) eff = Vcom - (Vp.a14 + 9/16 × Vs - 7/16 × Vn + Vv)
= (Vcom - Vp.a14) + 7/16 × Vn - 9/16 × Vs - Vv (Vp_b14) eff = (Vp.b14 - 7/16 × Vn - 7/16 × Vs + Vv) - Vcom
= (Vp.b14 - Vcom) - 7/16 × Vn - 7/16 × Vs + Vv (Vp_c14) eff = (Vp.c14 - 7/16 × Vs + 9/16 × Vn - Vv) - Vcom
= (Vp.c14 - Vcom) + 9/16 × Vn - 7/16 × Vs - Vv (Vp_d14) eff = Vcom - (Vp.d14 + 9/16 × Vn + 9/16 × Vs - Vv)
= (Vcom - Vp.d14) - 9/16 × Vn - 9/16 × Vs + Vv

<EFFECTIVE POTENTIALS OF THE PIXELS POSITIONED ABOVE AND BELOW> dVa_b = 7/8 × Vn - 1/8 × Vs - 2 × Vv dVb_c = Vn - 2 × Vv dVc_d = 9/8 × Vn + 1/8 × Vs - 2 × Vv dVd_e = Vn - 2 × Vv

FIG. 36

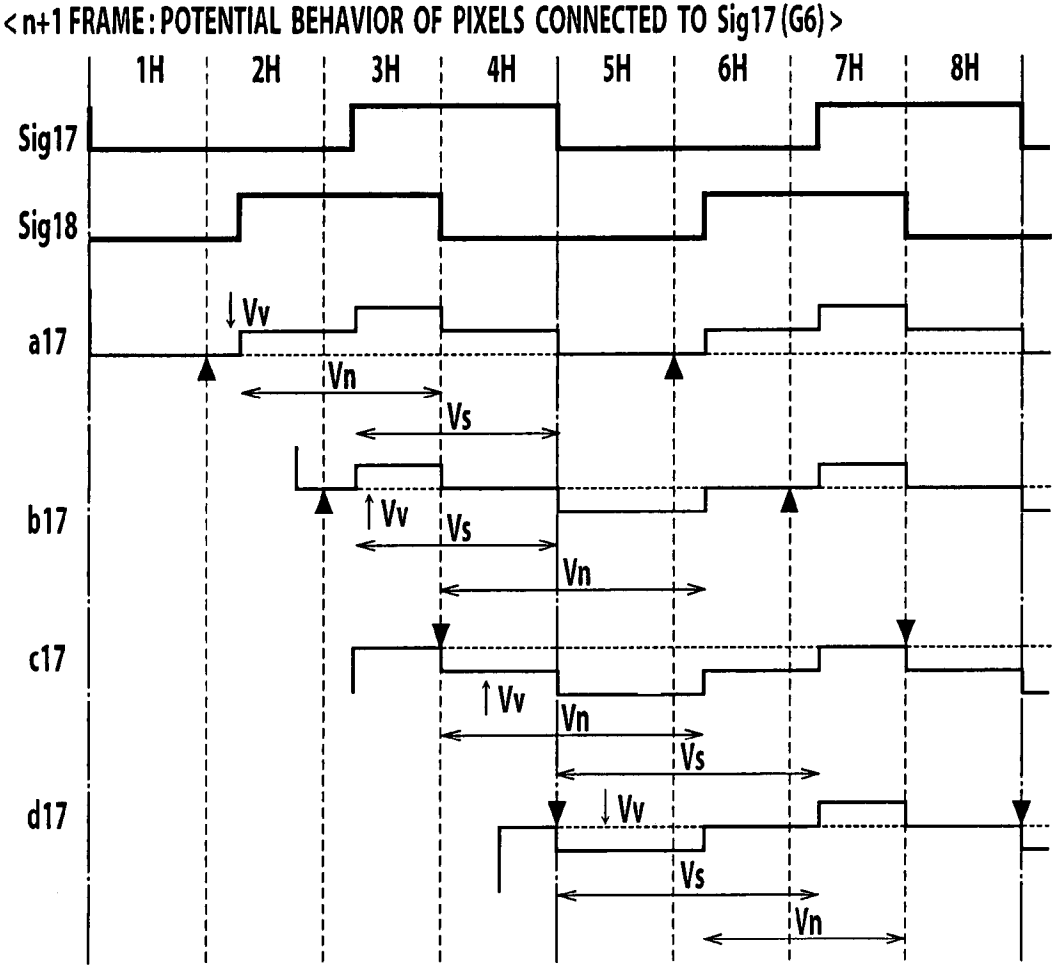

<EFFECTIVE POTENTIALS>

(Vp_a17) eff = Vcom - (Vp.a17 + 7/16 × Vn + 7/16 × Vs - Vv)
= (Vcom - Vp.a17) - 7/16 × Vn - 7/16 × Vs + Vv (Vp_b17) eff = Vcom - (Vp.b17 + 7/16 × Vs - 9/16 × Vn + Vv)
= (Vcom - Vp.b17) + 9/16 × Vn - 7/16 × Vs - Vv (Vp_c17) eff = (Vp.c17 - 9/16 × Vn - 9/16 × Vs + Vv) - Vcom
= (Vp.c17 - Vcom) - 9/16 × Vn - 9/16 × Vs + Vv (Vp_d17) eff = (Vp.d17 - 9/16 × Vs + 7/16 × Vn - Vv) - Vcom
= (Vp.d17 - Vcom) + 7/16 × Vn - 9/16 × Vs - Vv

<EFFECTIVE POTENTIALS OF THE PIXELS POSITIONED ABOVE AND BELOW> dVa_b = Vn - 2 × Vv dVb_c = 9/8 × Vn + 1/8 × Vs - 2 × Vv dVc_d = Vn - 2 × Vv dVd_e = 7/8 × Vn - 1/8 × Vs - 2 × Vv

FIG. 38

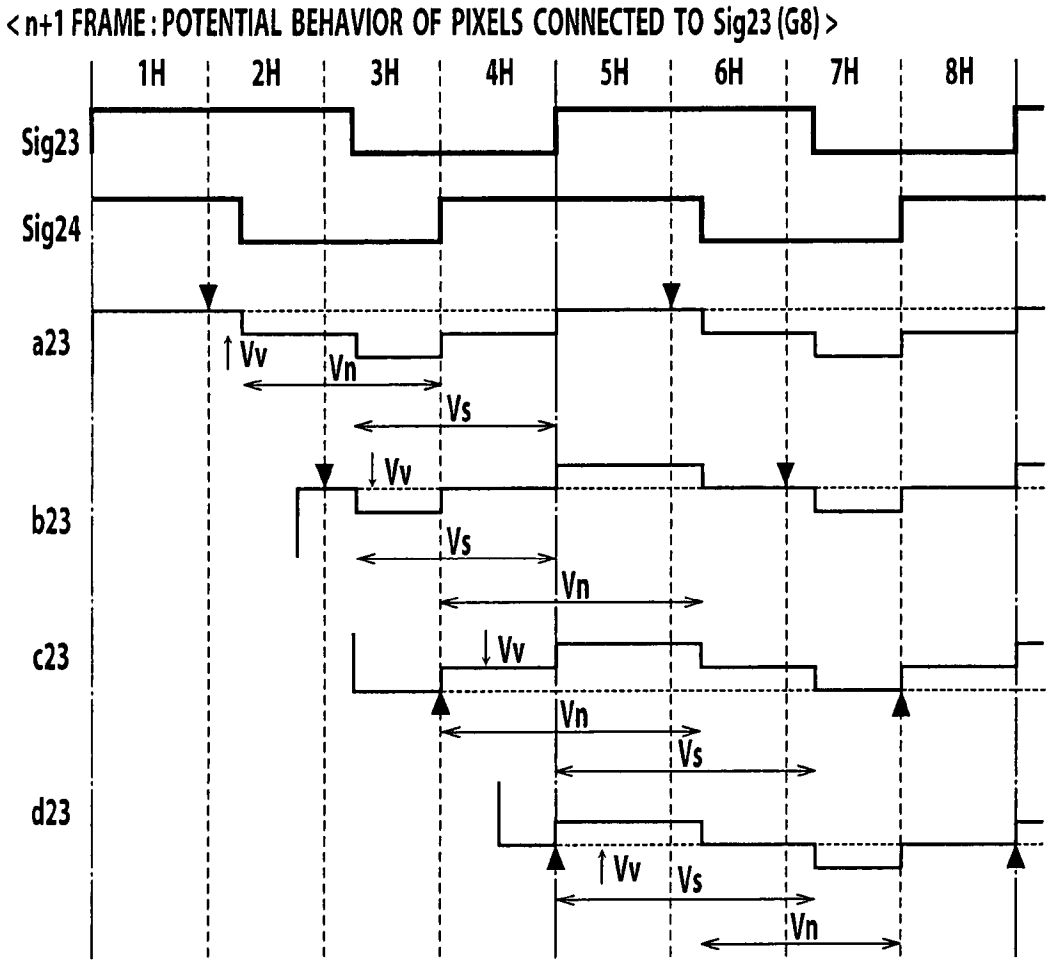

<EFFECTIVE POTENTIALS>

(Vp_a23) eff = (Vp.a23 - 7/16 × Vn - 7/16 × Vs + Vv) - Vcom
= (Vp.a23 - Vcom) - 7/16 × Vn - 7/16 × Vs + Vv (Vp_b23) eff = (Vp.b23 - 7/16 × Vs + 9/16 × Vn - Vv) - Vcom
= (Vp.b23 - Vcom) + 9/16 × Vn - 7/16 × Vs - Vv (Vp_c23) eff = Vcom - (Vp.c23 + 9/16 × Vn + 9/16 × Vs - Vv)
= (Vcom - Vp.c23) - 9/16 × Vn - 9/16 × Vs + Vv (Vp_d23) eff = Vcom - (Vp.d23 + 9/16 × Vs - 7/16 × Vn + Vv)
= (Vcom - Vp.d23) + 7/16 × Vn - 9/16 × Vs - Vv

<EFFECTIVE POTENTIALS OF THE PIXELS POSITIONED ABOVE AND BELOW> dVa_b = Vn - 2 × Vv dVb_c = 9/8 × Vn + 1/8 × Vs - 2 × Vv dVc_d = Vn - 2 × Vv dVd_e = 7/8 × Vn - 1/8 × Vs - 2 × Vv

FIG. 39A n FRAME

| | G1 | G2 | G3 | G4 | G5 | G6 | G7 | G8 |
|---|---|---|---|---|---|---|---|---|
| a | -1 | -2 | 0 | -2 | 1 | -2 | 0 | -2 |
| b | -2 | 1 | -2 | 1 | -2 | -1 | -2 | -1 |
| c | 1 | -2 | 0 | -2 | -1 | -2 | 0 | -2 |
| d | -2 | -1 | -2 | -1 | -2 | 1 | -2 | 1 |
| e | -1 | -2 | 0 | -2 | 1 | -2 | 0 | -2 |
| f | -2 | 1 | -2 | 1 | -2 | -1 | -2 | -1 |
| g | 1 | -2 | 0 | -2 | -1 | -2 | 0 | -2 |
| h | -2 | -1 | -2 | -1 | -2 | 1 | -2 | 1 |
| i | -1 | -2 | 0 | -2 | 1 | -2 | 0 | -2 |
| j | -2 | 1 | -2 | 1 | -2 | -1 | -2 | -1 |
| k | 1 | -2 | 0 | -2 | -1 | -2 | 0 | -2 |
| l | -2 | -1 | -2 | -1 | -2 | 1 | -2 | 1 |
| m | -1 | -2 | 0 | -2 | 1 | -2 | 0 | -2 |
| n | -2 | 1 | -2 | 1 | -2 | -1 | -2 | -1 |
| o | 1 | -2 | 0 | -2 | -1 | -2 | 0 | -2 |
| p | -2 | -1 | -2 | -1 | -2 | 1 | -2 | 1 |

FIG. 39B n+1 FRAME

| | G1 | G2 | G3 | G4 | G5 | G6 | G7 | G8 |
|---|---|---|---|---|---|---|---|---|
| a | -1 | -2 | 0 | -2 | 1 | -2 | 0 | -2 |
| b | -2 | 1 | -2 | 1 | -2 | -1 | -2 | -1 |
| c | 1 | -2 | 0 | -2 | -1 | -2 | 0 | -2 |
| d | -2 | -1 | -2 | -1 | -2 | 1 | -2 | 1 |
| e | -1 | -2 | 0 | -2 | 1 | -2 | 0 | -2 |
| f | -2 | 1 | -2 | 1 | -2 | -1 | -2 | -1 |
| g | 1 | -2 | 0 | -2 | -1 | -2 | 0 | -2 |
| h | -2 | -1 | -2 | -1 | -2 | 1 | -2 | 1 |
| i | -1 | -2 | 0 | -2 | 1 | -2 | 0 | -2 |
| j | -2 | 1 | -2 | 1 | -2 | -1 | -2 | -1 |
| k | 1 | -2 | 0 | -2 | -1 | -2 | 0 | -2 |
| l | -2 | -1 | -2 | -1 | -2 | 1 | -2 | 1 |
| m | -1 | -2 | 0 | -2 | 1 | -2 | 0 | -2 |
| n | -2 | 1 | -2 | 1 | -2 | -1 | -2 | -1 |
| o | 1 | -2 | 0 | -2 | -1 | -2 | 0 | -2 |
| p | -2 | -1 | -2 | -1 | -2 | 1 | -2 | 1 |

FIG. 39C

AVERAGE

| | G1 | G2 | G3 | G4 | G5 | G6 | G7 | G8 |
|---|---|---|---|---|---|---|---|---|
| a | -1 | -2 | 0 | -2 | 1 | -2 | 0 | -2 |
| b | -2 | 1 | -2 | 1 | -2 | -1 | -2 | -1 |
| c | 1 | -2 | 0 | -2 | -1 | -2 | 0 | -2 |
| d | -2 | -1 | -2 | -1 | -2 | 1 | -2 | 1 |
| e | -1 | -2 | 0 | -2 | 1 | -2 | 0 | -2 |
| f | -2 | 1 | -2 | 1 | -2 | -1 | -2 | -1 |
| g | 1 | -2 | 0 | -2 | -1 | -2 | 0 | -2 |
| h | -2 | -1 | -2 | -1 | -2 | 1 | -2 | 1 |
| i | -1 | -2 | 0 | -2 | 1 | -2 | 0 | -2 |
| j | -2 | 1 | -2 | 1 | -2 | -1 | -2 | -1 |
| k | 1 | -2 | 0 | -2 | -1 | -2 | 0 | -2 |
| l | -2 | -1 | -2 | -1 | -2 | 1 | -2 | 1 |
| m | -1 | -2 | 0 | -2 | 1 | -2 | 0 | -2 |
| n | -2 | 1 | -2 | 1 | -2 | -1 | -2 | -1 |
| o | 1 | -2 | 0 | -2 | -1 | -2 | 0 | -2 |
| p | -2 | -1 | -2 | -1 | -2 | 1 | -2 | 1 |

FIG. 40 A n FRAME

| | G1 | G2 | G3 | G4 | G5 | G6 | G7 | G8 |
|---|---|---|---|---|---|---|---|---|
| a | -1 | -2 | 0 | -2 | 1 | -2 | 0 | -2 |
| b | -2 | 1 | -2 | 1 | -2 | -1 | -2 | -1 |
| c | 1 | -2 | 0 | -2 | -1 | -2 | 0 | -2 |
| d | -2 | -1 | -2 | -1 | -2 | 1 | -2 | 1 |
| e | -1 | -2 | 0 | -2 | 1 | -2 | 0 | -2 |
| f | -2 | 1 | -2 | 1 | -2 | -1 | -2 | -1 |
| g | 1 | -2 | 0 | -2 | -1 | -2 | 0 | -2 |
| h | -2 | -1 | -2 | -1 | -2 | 1 | -2 | 1 |
| i | -1 | -2 | 0 | -2 | 1 | -2 | 0 | -2 |
| j | -2 | 1 | -2 | 1 | -2 | -1 | -2 | -1 |
| k | 1 | -2 | 0 | -2 | -1 | -2 | 0 | -2 |
| l | -2 | -1 | -2 | -1 | -2 | 1 | -2 | 1 |
| m | -1 | -2 | 0 | -2 | 1 | -2 | 0 | -2 |
| n | -2 | 1 | -2 | 1 | -2 | -1 | -2 | -1 |
| o | 1 | -2 | 0 | -2 | -1 | -2 | 0 | -2 |
| p | -2 | -1 | -2 | -1 | -2 | 1 | -2 | 1 |

FIG. 40 B n+1 FRAME

| | G1 | G2 | G3 | G4 | G5 | G6 | G7 | G8 |
|---|---|---|---|---|---|---|---|---|
| a | 1 | -2 | 0 | -2 | -1 | -2 | 0 | -2 |
| b | -2 | -1 | -2 | -1 | -2 | 1 | -2 | 1 |
| c | -1 | -2 | 0 | -2 | 1 | -2 | 0 | -2 |
| d | -2 | -1 | -2 | -1 | -2 | -1 | -2 | -1 |
| e | 1 | -2 | 0 | -2 | -1 | -2 | 0 | -2 |
| f | -2 | -1 | -2 | -1 | -2 | 1 | -2 | 1 |
| g | -1 | -2 | 0 | -2 | 1 | -2 | 0 | -2 |
| h | -2 | 1 | -2 | 1 | -2 | -1 | -2 | -1 |
| i | 1 | -2 | 0 | -2 | -1 | -2 | 0 | -2 |
| j | -2 | -1 | -2 | -1 | -2 | 1 | -2 | 1 |
| k | -1 | -2 | 0 | -2 | 1 | -2 | 0 | -2 |
| l | -2 | 1 | -2 | 1 | -2 | -1 | -2 | -1 |
| m | 1 | -2 | 0 | -2 | -1 | -2 | 0 | -2 |
| n | -2 | -1 | -2 | -1 | -2 | 1 | -2 | 1 |
| o | -1 | -2 | 0 | -2 | 1 | -2 | 0 | -2 |
| p | -2 | 1 | -2 | 1 | -2 | -1 | -2 | -1 |

FIG. 40 C

AVERAGE

| | G1 | G2 | G3 | G4 | G5 | G6 | G7 | G8 |
|---|---|---|---|---|---|---|---|---|
| a | 0 | -2 | 0 | -2 | 0 | -2 | 0 | -2 |
| b | -2 | 0 | -2 | 0 | -2 | 0 | -2 | 0 |
| c | 0 | -2 | 0 | -2 | 0 | -2 | 0 | -2 |
| d | -2 | 0 | -2 | 0 | -2 | 0 | -2 | 0 |
| e | 0 | -2 | 0 | -2 | 0 | -2 | 0 | -2 |
| f | -2 | 0 | -2 | 0 | -2 | 0 | -2 | 0 |
| g | 0 | -2 | 0 | -2 | 0 | -2 | 0 | -2 |
| h | -2 | 0 | -2 | 0 | -2 | 0 | -2 | 0 |
| i | 0 | -2 | 0 | -2 | 0 | -2 | 0 | -2 |
| j | -2 | 0 | -2 | 0 | -2 | 0 | -2 | 0 |
| k | 0 | -2 | 0 | -2 | 0 | -2 | 0 | -2 |
| l | -2 | 0 | -2 | 0 | -2 | 0 | -2 | 0 |
| m | 0 | -2 | 0 | -2 | 0 | -2 | 0 | -2 |
| n | -2 | 0 | -2 | 0 | -2 | 0 | -2 | 0 |
| o | 0 | -2 | 0 | -2 | 0 | -2 | 0 | -2 |
| p | -2 | 0 | -2 | 0 | -2 | 0 | -2 | 0 |

LIQUID CRYSTAL DISPLAY DEVICE

CROSS-REFERENCE TO RELATED APPLICATIONS

This application is based upon and claims the benefit of priority from Japanese Patent Application No. 2003-293318 filed Aug. 14, 2003 and Japanese Patent Application No. 2004-40128 filed Feb. 17, 2004; the entire contents of which are incorporated herein by reference.

BACKGROUND OF THE INVENTION

1. Field of the Invention

The present invention relates to an active matrix liquid crystal display device.

2. Description of the Related Art

In a word processor, a personal computer, a portable TV and the like, a thin and lightweight display device is widely used. Particularly, since it is easy to realize a thin and lightweight liquid crystal display device with low power consumption, there has been extensive development of the liquid crystal display device. Accordingly, a liquid crystal display device with high resolution and a large-sized screen has been available at a relatively low price.

Among the liquid crystal display devices, an active matrix liquid crystal display device, in which thin film transistors (TFTs) are disposed at respective intersections between a plurality of signal lines and a plurality of scan lines, is excellent in color reproduction and has fewer afterimages. Thus, it is considered that the active matrix liquid crystal display device will become mainstream in the future.

In a conventional active matrix liquid crystal display device, drive circuits which drive signal lines and scan lines are formed on a substrate different from an array substrate having the signal lines and the scan lines disposed thereon. Thus, it was impossible to miniaturize the whole liquid crystal display device. Consequently, there has been extensive development of a manufacturing process of integrally forming the drive circuits on the array substrate.

In a liquid crystal display device using amorphous silicon TFTs, drive ICs (integrated circuits), on which TCPs (tape carrier packages) are mounted by use of a TAB (tape automated bonding) method, supply video signals to signal lines from outside an array substrate. However, along with realization of high definition pixels, the number of connection wirings on the array substrate for connecting the drive ICs to the array substrate is increased. Thus, it is difficult to secure a sufficient pitch between these connection wirings.

Meanwhile, in a liquid crystal display device using polysilicon TFTs, a scan line drive circuit and a signal line drive circuit can be integrally formed on an array substrate. Thus, the number of external connection parts can be reduced. Moreover, cost reduction and reduction in the number of connection wirings can be achieved. As a technology of realizing the cost reduction by further reducing the number of external connection parts, for example, there is signal line selective drive described in Japanese Patent Laid-Open Publication No. 2001-312255. This technology is intended to reduce the scale of drive ICs in such a manner that the number of video output lines extended from the drive ICs is reduced to half, each of the video output lines is allowed to correspond to two signal lines on an array substrate and any one of the two signal lines is selectively switched and connected to the video output line.

Moreover, as a method for driving signal lines which write video signals into pixels, a V line inversion drive method and a H/V inversion drive method are known. In the V line inversion drive method, polarities of video signals supplied to signal lines for each vertical scan period are switched between positive and negative and video signals having inverted polarities are supplied to adjacent signal lines. In the H/V line inversion drive method, polarities of video signals supplied to signal lines for each horizontal scan period are switched between positive and negative and video signals having inverted polarities are supplied to adjacent signal lines.

However, when the V line inversion drive method is applied to the signal line selective drive, there is a deviation caused in a distribution of polarities for entire pixels. Thus, there is a problem that display failure called a crosstalk, which has a tail along a window pattern in displaying the window pattern, is likely to occur.

Moreover, when the H/V inversion drive method is applied to the signal line selective drive, since an inversion cycle of video signals is short, in addition to a conventional problem such as increased power consumption, there is the following problem. Specifically, in half-tone raster display, when a video signal is supplied to a selected signal line, the video signal changes a potential of an adjacent signal line in a floating state through coupling capacities between its own pixel and its own signal line, between its own pixel and an adjacent signal line and between its own signal line and the adjacent signal line, respectively. Thus, there is a problem that there occurs a difference in write potentials into pixels for each signal line and uneven display occurs.

SUMMARY OF THE INVENTION

It is an object of the present invention to provide a liquid crystal display device capable of reducing the scale of drive ICs and preventing uneven display in the case of adopting signal line selective drive.

A first aspect of the present invention is a liquid crystal display device including: a pixel display part in which pixels are disposed at respective intersections of a plurality of scan lines and a plurality of signal lines; drive ICs which supply video signals through video output lines; switching circuits, each of which connects a signal line selected from N signal lines (N is an integer of 3 or more) to the video output line for each of groups in which each of the video output lines from the drive ICs corresponds to N signal lines; and a control circuit which selects first a signal line to which a video signal having its polarity inverted between an L−1th line (L is an integer not less than 2) and an Lth line is supplied and selects later a signal line to which a video signal having its polarity not inverted is supplied, for each of the groups in writing video signals into respective pixels in the Lth scan line via the signal lines.

In the present invention, for each group in which each of the video output lines corresponds to N signal lines, the selected signal line is connected to the video output line. Thus, the number of the video output lines is reduced to 1/N and the scale of the drive ICs is reduced.

Moreover, as to the Lth scan line, for each of the groups, the signal line to which the video signal having its polarity inverted between the L−1th scan line and the Lth scan line is supplied is selected first and the signal line to which the video signal having its polarity not inverted is supplied is selected later. Specifically, the video signal having the polarity not inverted has no potential change and adjacent signal lines are not influenced by the potential change. Thus, such a video signal is supplied to the signal line later. Consequently, all the signal lines can write the video signals into the pixels without being influenced by the potential change.

As described above, according to the present invention, by reducing the scale of the drive ICs, cost reduction can be achieved and power consumption can be suppressed. Moreover, since all the signal lines are not influenced by the potential change, potentials of the respective pixels are not changed. Accordingly, uneven display can be prevented. Thus, a liquid crystal display device capable of high-quality image display can be realized.

A second aspect of the present invention is that the control circuit controls a selection order of a plurality of signal lines to be selected first in each group as well as a selection order of a plurality of signal lines to be selected later in such a manner that write conditions of the respective pixels are distributed evenly across the entire display screen, the write conditions being related to presence of polarity inversion of a video signal between the L−1th line and the Lth line as to each of the signal ines and presence of polarity inversion of a video signal between a signal line selected to be an S−1th (S is an integer not less than 1) and a signal line selected to be an Sth.

In the present invention, the selection order of the signal lines is controlled so as to evenly distribute the write conditions of the video signals as to all the signal lines. Thus, uneven display caused by write deficiency can be made hard to be visible.

A third aspect of the present invention is that the control circuit changes the selection order of signal lines selected first in each group as well as the selection order of signal lines selected later, for each of frames with a fixed interval therebetween.

In the present invention, average balance of effective potentials in the respective pixels can be achieved between a plurality of frames. Consequently, average effective potentials when viewed as the entire screen are regularly arranged. Thus, the uneven display can be made hard to be visible.

An upper table of FIG. 9 shows orders of selecting signal lines in one horizontal scan period and polarities of video signals for each of pixels. A lower table of FIG. 9 shows a table applied four write conditions (A) to (D) based on the selection orders and the polarities of the video signals in the upper table.

An upper table of FIG. 10 shows selection orders of signal lines and polarities of video signals for each of pixels when the selection order of signal lines is controlled so as to evenly distribute the four write conditions (A) to (D) on the entire display screen. A lower table of FIG. 10 shows a table applied the four write conditions based on the selection orders and the polarities of the video signals in the upper table.

Figure 11:
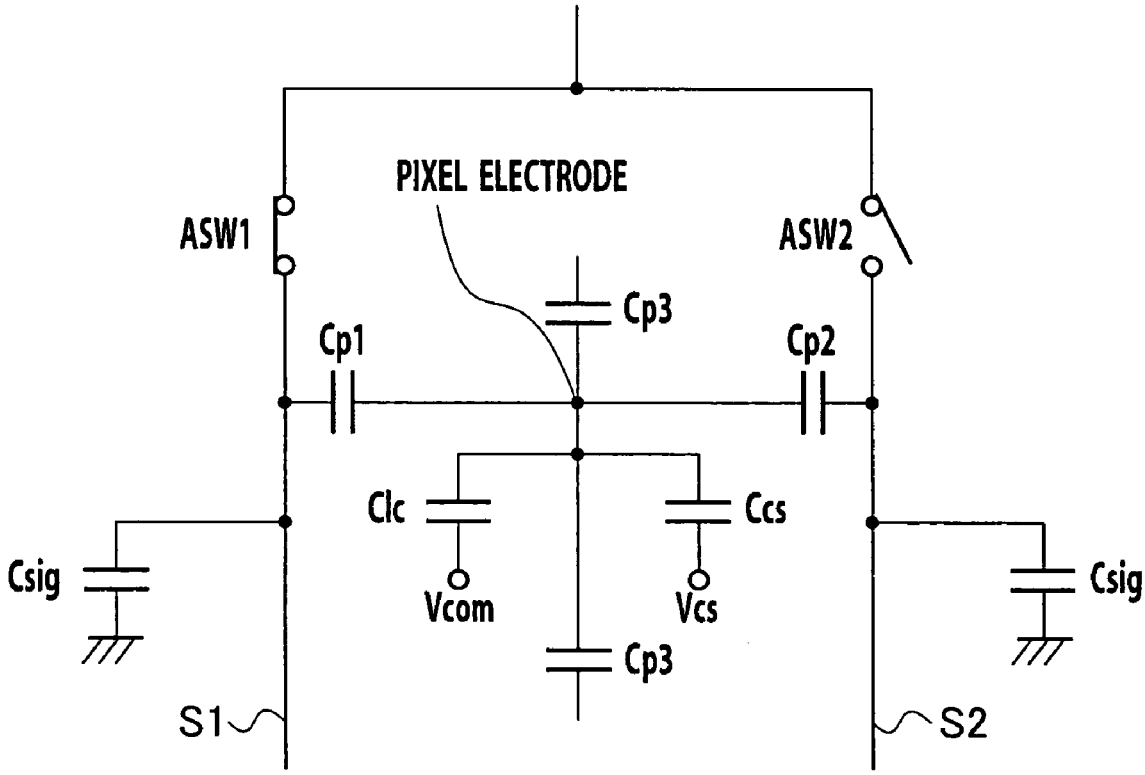

FIG. 11 shows an equivalent circuit in a peripheral portion of one pixel electrode.

FIG. 12 shows polarities of respective pixels and selection orders of signal lines in the nth frame.

An upper side of FIG. 13 shows voltage waveforms of a selected signal line (Sig2) and its adjacent signal line (Sig3) in the nth frame. A lower side of FIG. 13 shows voltage waveforms of respective pixels connected to the signal line (Sig2).

An upper side of FIG. 14 shows voltage waveforms of a selected signal line (Sig5) and its adjacent signal line (Sig6) in the nth frame. A lower side of FIG. 14 shows voltage waveforms of respective pixels connected to the signal line (Sig5).

An upper side of FIG. 15 shows voltage waveforms of a selected signal line (Sig8) and its adjacent signal line (Sig9) in the nth frame. A lower side of FIG. 15 shows voltage waveforms of respective pixels connected to the signal line (Sig8).

An upper side of FIG. 16 shows voltage waveforms of a selected signal line (Sig11) and its adjacent signal line (Sig12) in the nth frame. A lower side of FIG. 16 shows voltage waveforms of respective pixels connected to the signal line (Sig11).

Figure 17:
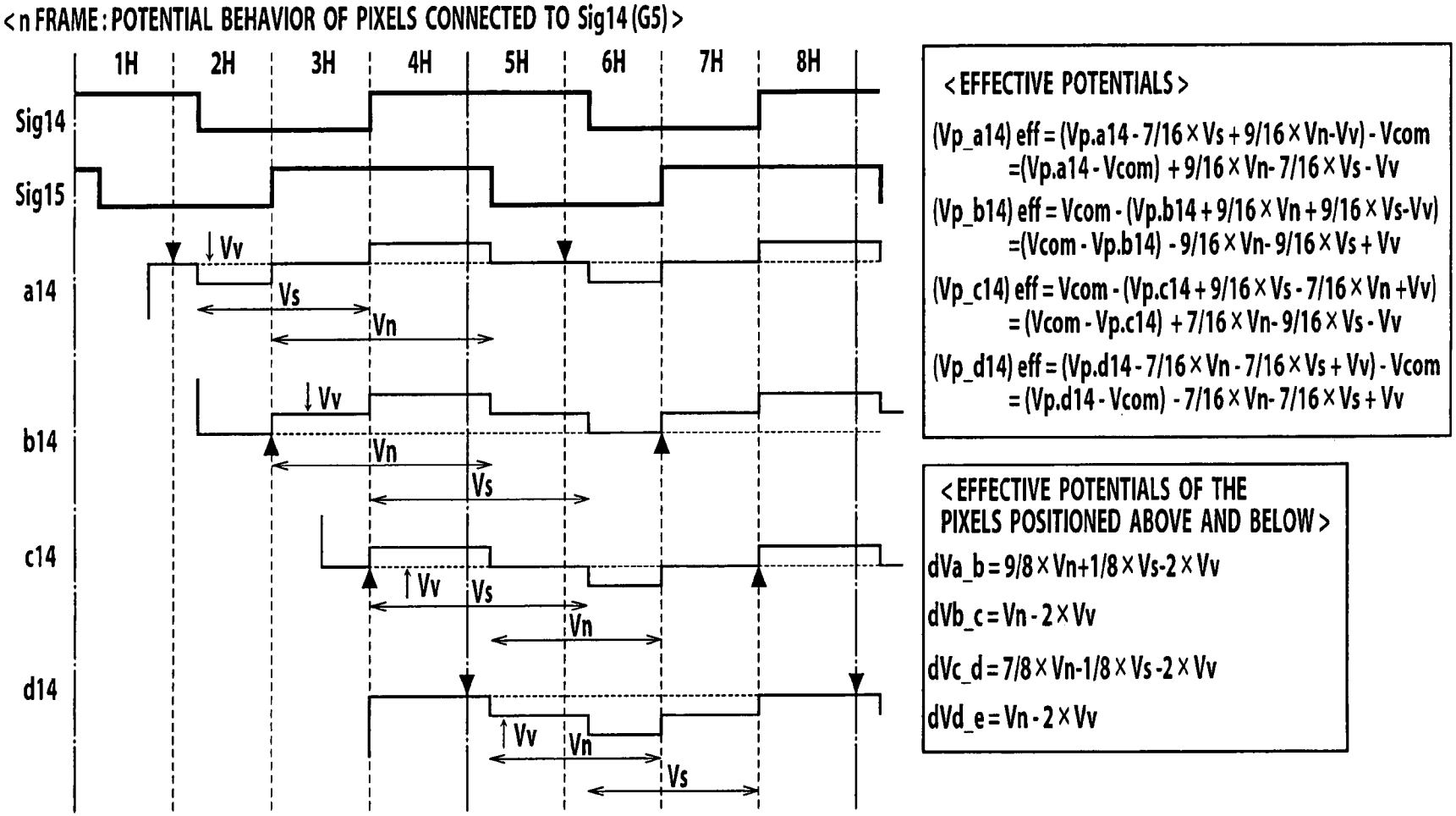

An upper side of FIG. 17 shows voltage waveforms of a selected signal line (Sig14) and its adjacent signal line (Sig15) in the nth frame. A lower side of FIG. 17 shows voltage waveforms of respective pixels connected to the signal line (Sig14).

Figure 18:
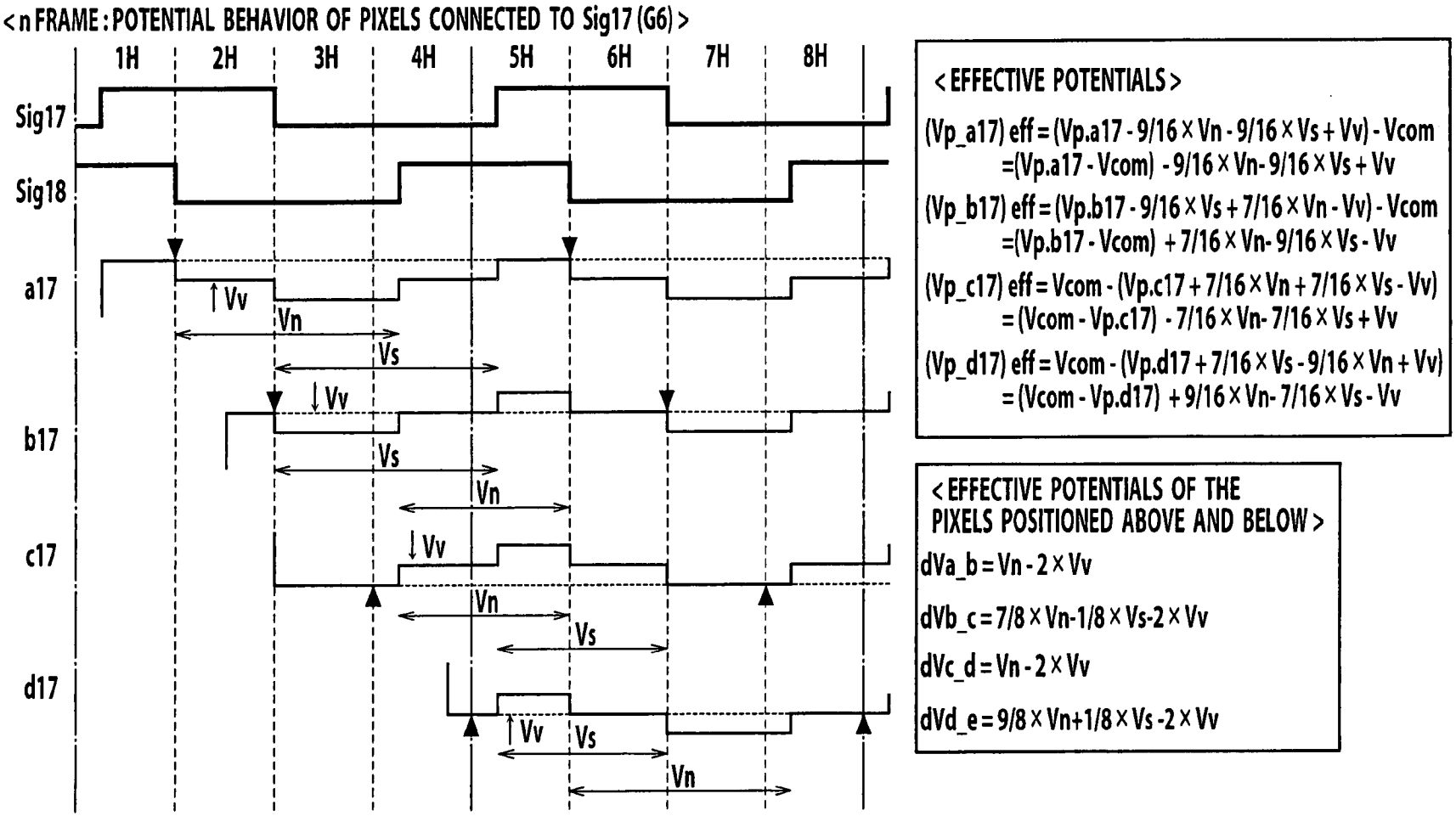

An upper side of FIG. 18 shows voltage waveforms of a selected signal line (Sig17) and its adjacent signal line (Sig18) in the nth frame. A lower side of FIG. 18 shows voltage waveforms of respective pixels connected to the signal line (Sig17).

Figure 19:
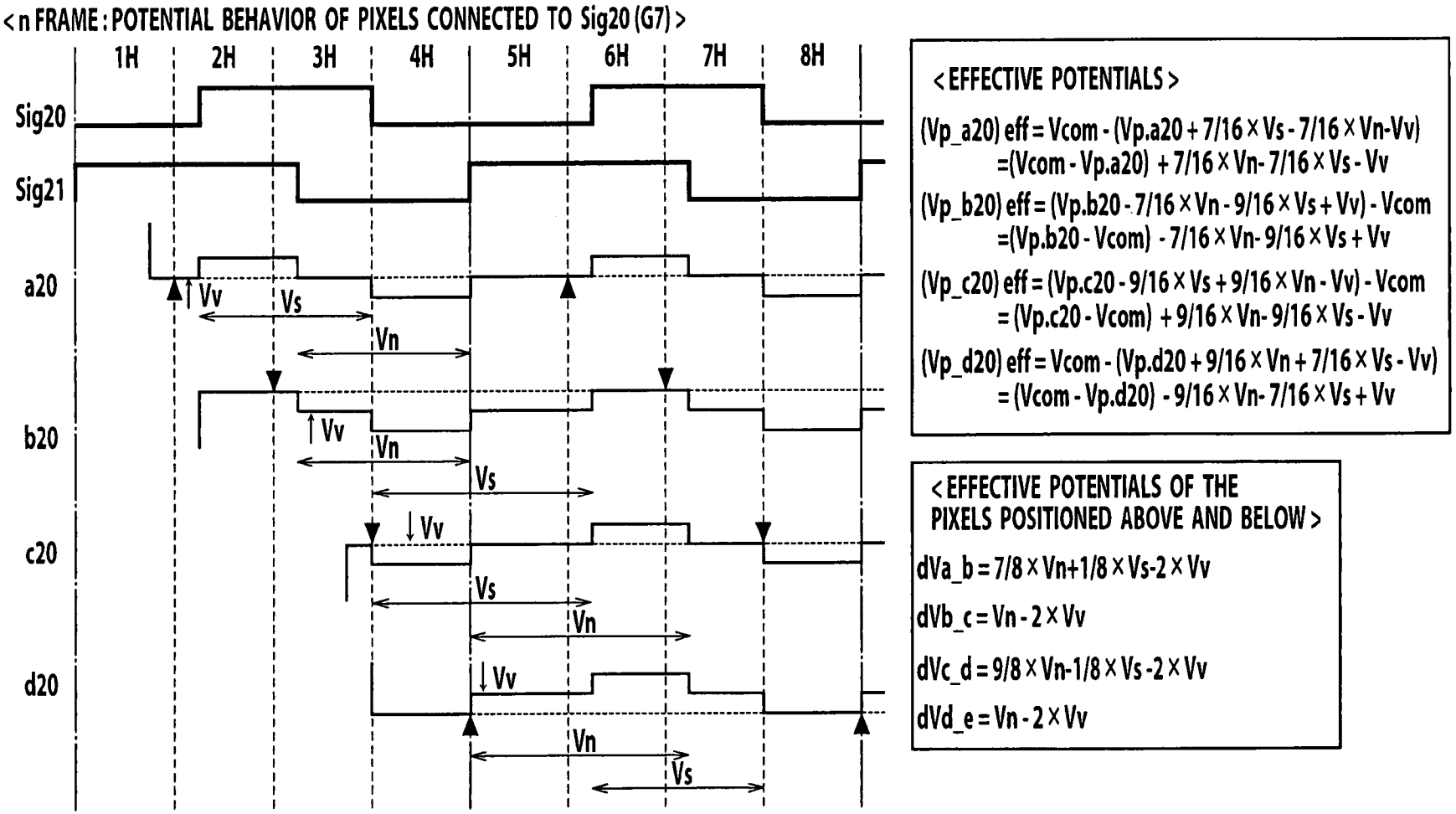

An upper side of FIG. 19 shows voltage waveforms of a selected signal line (Sig20) and its adjacent signal line (Sig21) in the nth frame. A lower side of FIG. 19 shows voltage waveforms of respective pixels connected to the signal line (Sig20).

An upper side of FIG. 20 shows voltage waveforms of a selected signal line (Sig23) and its adjacent signal line (Sig24) in the nth frame. A lower side of FIG. 20 shows voltage waveforms of respective pixels connected to the signal line (Sig23).

FIG. 21 shows polarities of respective pixels and selection orders of signal lines in the n+1th frame when the nth frame and the n+1th frame have the same writing order.

Figure 22:
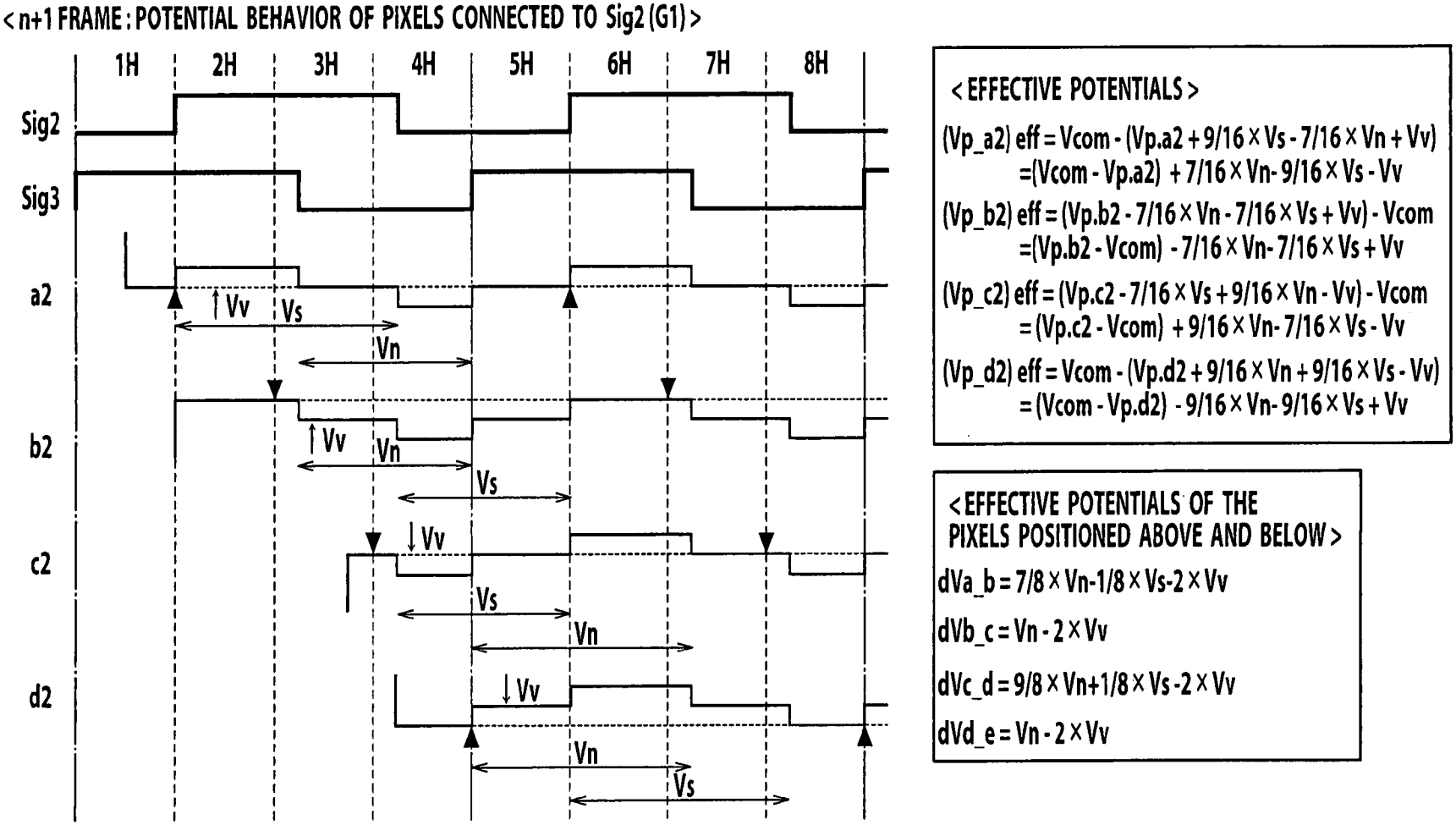

An upper side of FIG. 22 shows voltage waveforms of a selected signal line (Sig2) and its adjacent signal line (Sig3) in the n+1th frame when the same writing order as that of the nth frame is adopted. A lower side of FIG. 22 shows voltage waveforms of respective pixels connected to the signal line (Sig2).

Figure 23:
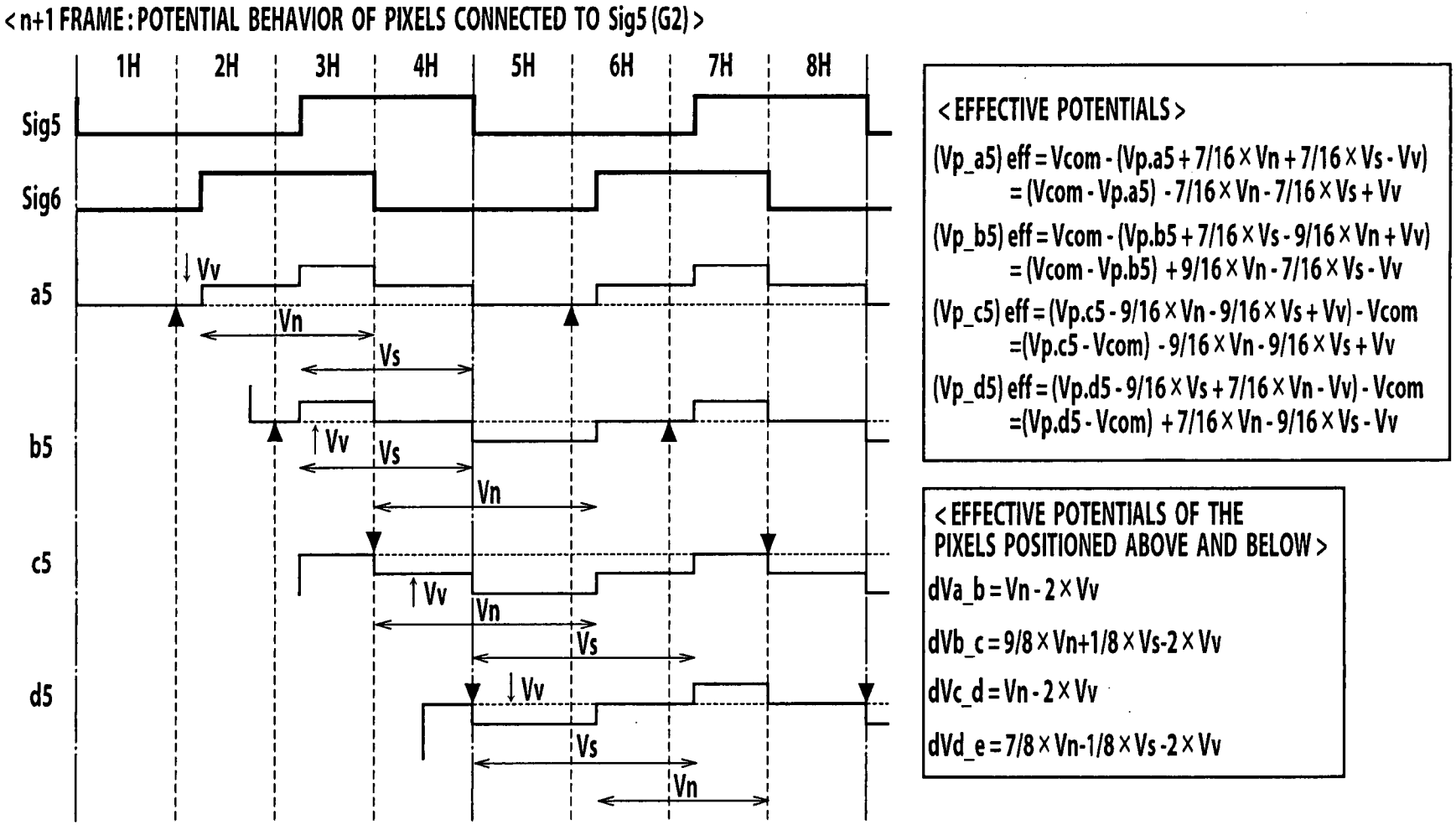

An upper side of FIG. 23 shows voltage waveforms of a selected signal line (Sig5) and its adjacent signal line (Sig6) in the n+1th frame when the same writing order as that of the nth frame is adopted. A lower side of FIG. 23 shows voltage waveforms of respective pixels connected to the signal line (Sig5).

Figure 24:
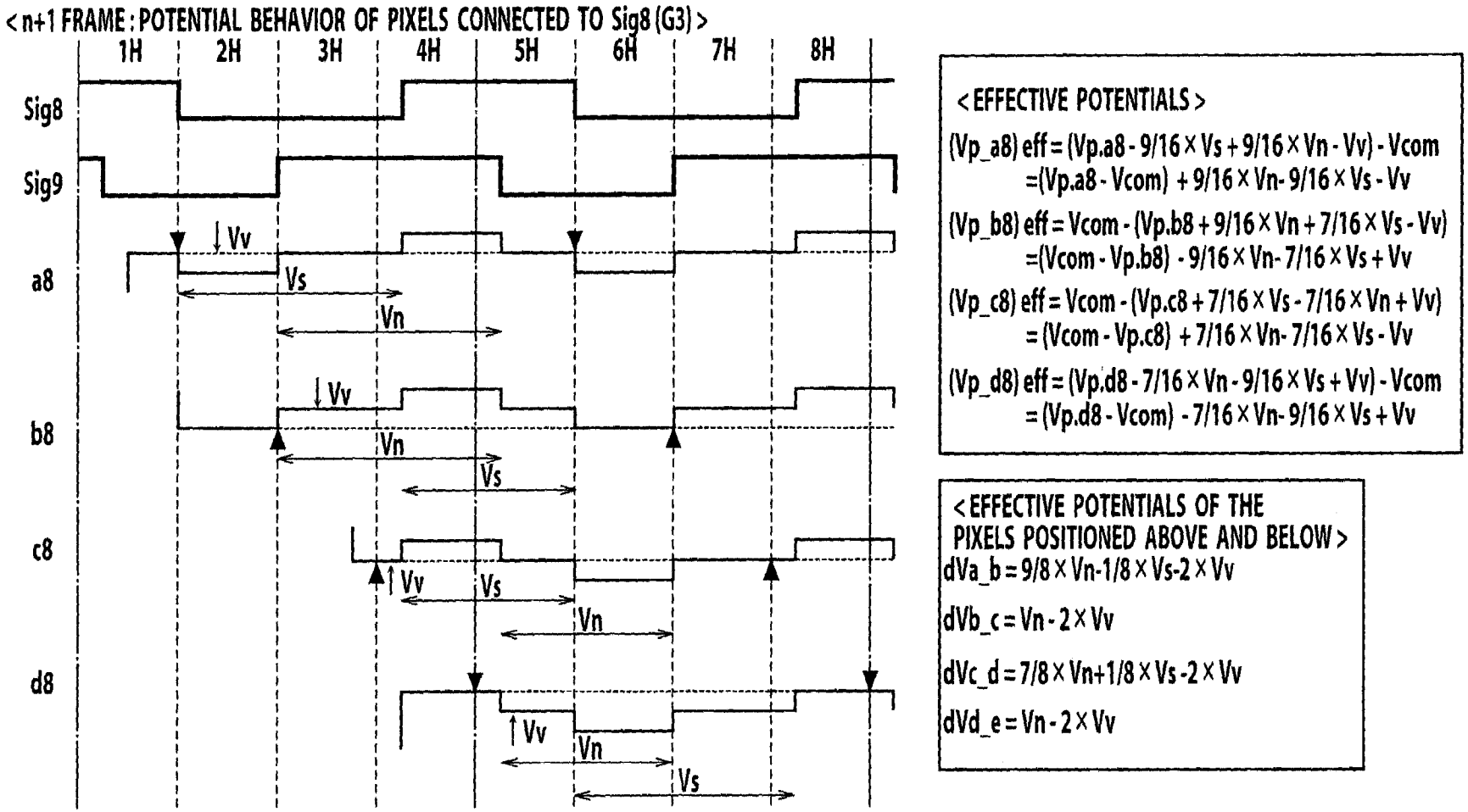

An upper side of FIG. 24 shows voltage waveforms of a selected signal line (Sig8) and its adjacent signal line (Sig9) in the n+1th frame when the same writing order as that of the nth frame is adopted. A lower side of FIG. 24 shows voltage waveforms of respective pixels connected to the signal line (Sig8).

Figure 25:
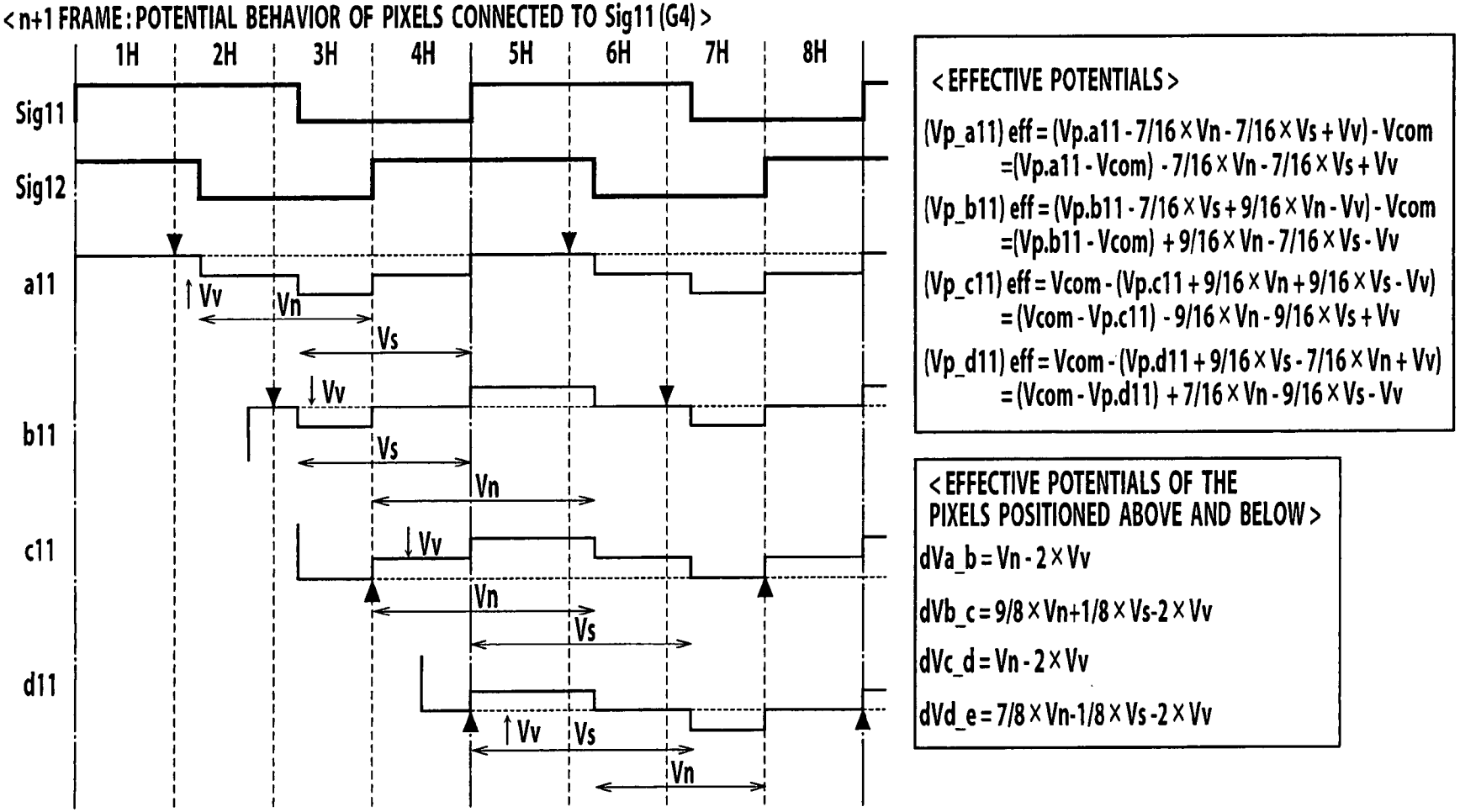

An upper side of FIG. 25 shows voltage waveforms of a selected signal line (Sig11) and its adjacent signal line (Sig12) in the n+1th frame when the same writing order as that of the nth frame is adopted. A lower side of FIG. 25 shows voltage waveforms of respective pixels connected to the signal line (Sig11).

Figure 26:
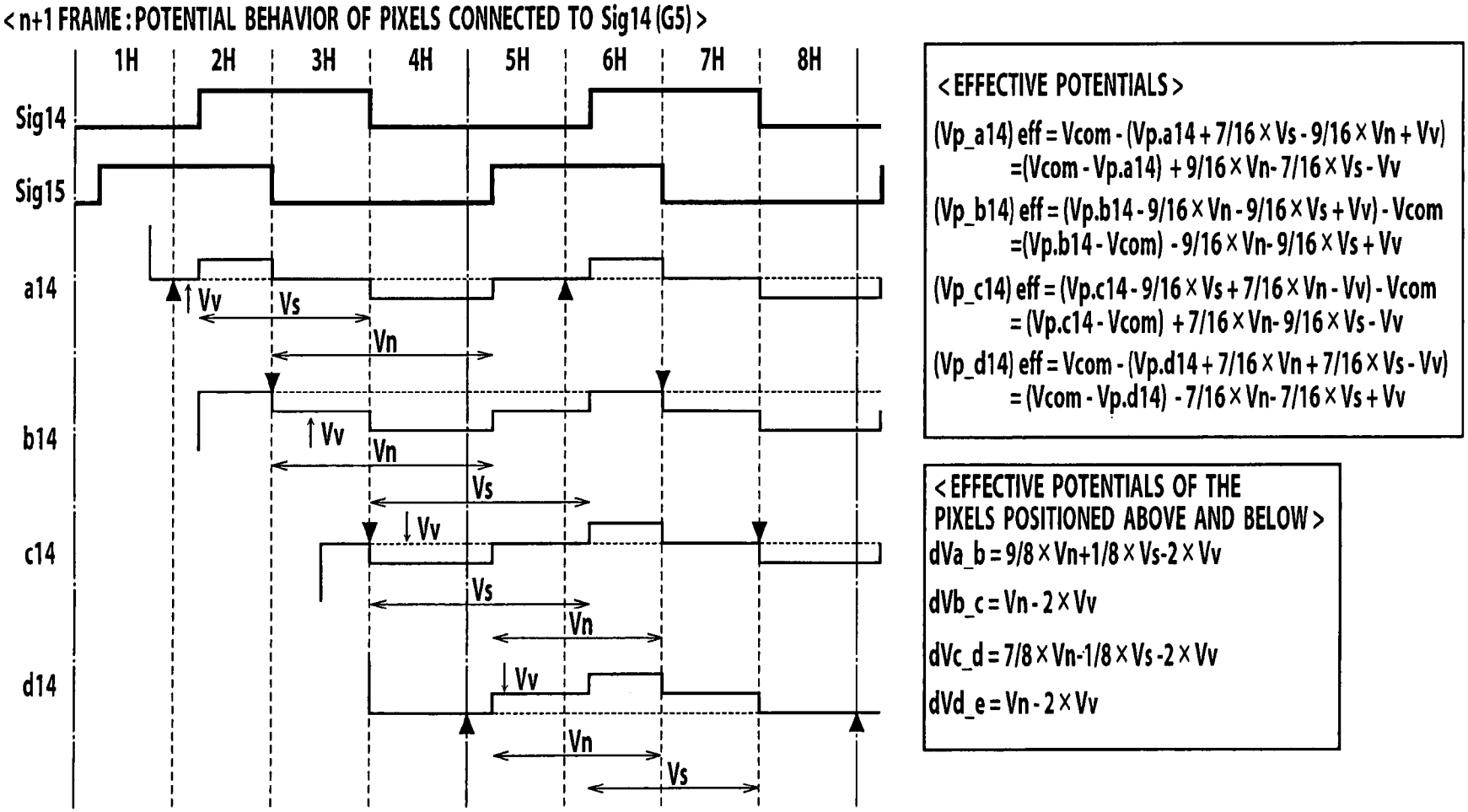

An upper side of FIG. 26 shows voltage waveforms of a selected signal line (Sig14) and its adjacent signal line (Sig15) in the n+1th frame when the same writing order as that of the nth frame is adopted. A lower side of FIG. 26 shows voltage waveforms of respective pixels connected to the signal line (Sig14).

An upper side of FIG. 27 shows voltage waveforms of a selected signal line (Sig17) and its adjacent signal line (Sig18) in the n+1th frame when the same writing order as that of the nth frame is adopted. A lower side of FIG. 27 shows voltage waveforms of respective pixels connected to the signal line (Sig17).

An upper side of FIG. 28 shows voltage waveforms of a selected signal line (Sig20) and its adjacent signal line (Sig21) in the n+1th frame when the same writing order as that of the nth frame is adopted. A lower side of FIG. 28 shows voltage waveforms of respective pixels connected to the signal line (Sig20).

An upper side of FIG. 29 shows voltage waveforms of a selected signal line (Sig23) and its adjacent signal line (Sig24) in the n+1th frame when the same writing order as that of the nth frame is adopted. A lower side of FIG. 29 shows voltage waveforms of respective pixels connected to the signal line (Sig23).

FIG. 30 shows polarities of respective pixels and selection orders of signal lines in the n+1th frame when the writing order is changed between the nth frame and the n+1th frame.

An upper side of FIG. 31 shows voltage waveforms of a selected signal line (Sig2) and its adjacent signal line (Sig3) in the n+1th frame when the writing order is changed between the nth frame and the n+1th frame. A lower side of FIG. 31 shows voltage waveforms of respective pixels connected to the signal line (Sig2).

Figure 32:
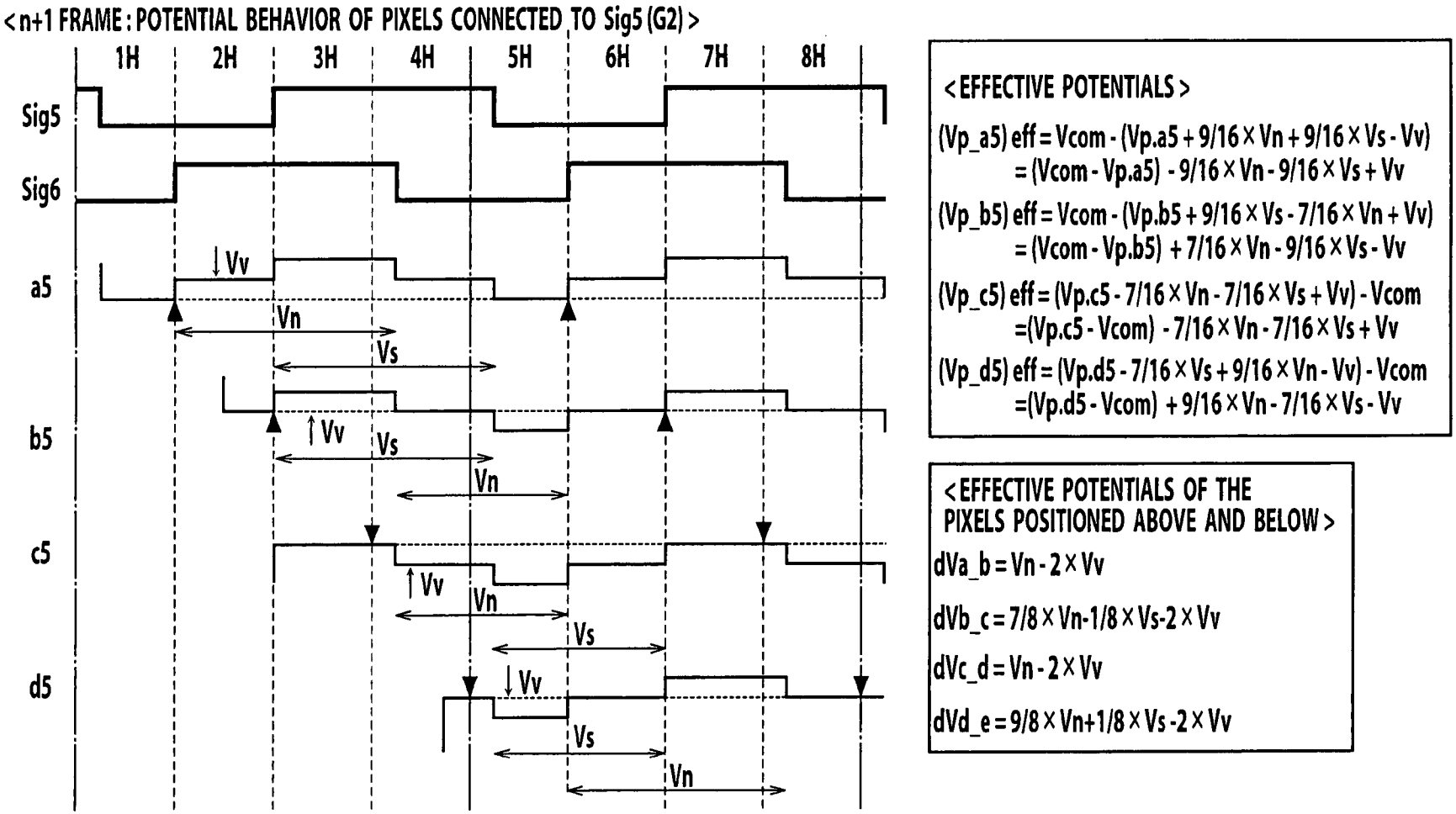

An upper side of FIG. 32 shows voltage waveforms of a selected signal line (Sig5) and its adjacent signal line (Sig6) in the n+1th frame when the writing order is changed between the nth frame and the n+1th frame. A lower side of FIG. 32 shows voltage waveforms of respective pixels connected to the signal line (Sig5).

An upper side of FIG. 33 shows voltage waveforms of a selected signal line (Sig8) and its adjacent signal line (Sig9) in the n+1th frame when the writing order is changed between the nth frame and the n+1th frame. A lower side of FIG. 33 shows voltage waveforms of respective pixels connected to the signal line (Sig8).

An upper side of FIG. 34 shows voltage waveforms of a selected signal line (Sig11) and its adjacent signal line (Sig12) in the n+1th frame when the writing order is changed between the nth frame and the n+1th frame. A lower side of FIG. 34 shows voltage waveforms of respective pixels connected to the signal line (Sig12).

An upper side of FIG. 35 shows voltage waveforms of a selected signal line (Sig14) and its adjacent signal line (Sig15) in the n+1th frame when the writing order is changed between the nth frame and the n+1th frame. A lower side of FIG. 35 shows voltage waveforms of respective pixels connected to the signal line (Sig14).

An upper side of FIG. 36 shows voltage waveforms of a selected signal line (Sig17) and its adjacent signal line (Sig18) in the n+1th frame when the writing order is changed between the nth frame and the n+1th frame. A lower side of FIG. 36 shows voltage waveforms of respective pixels connected to the signal line (Sig17).

Figure 37:
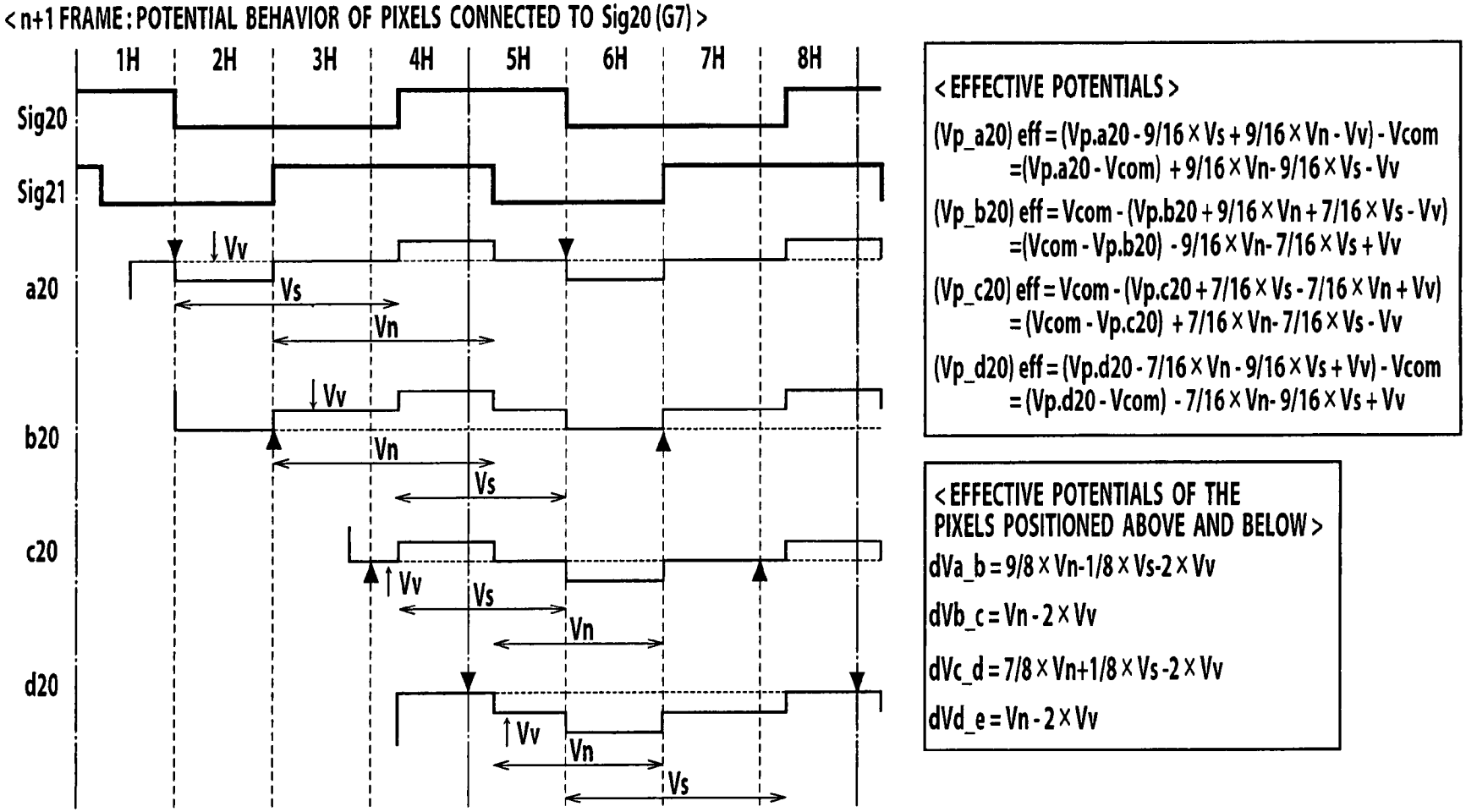

An upper side of FIG. 37 shows voltage waveforms of a selected signal line (Sig20) and its adjacent signal line (Sig21) in the n+1th frame when the writing order is changed between the nth frame and the n+1th frame. A lower side of FIG. 37 shows voltage waveforms of respective pixels connected to the signal line (Sig20).

An upper side of FIG. 38 shows voltage waveforms of a selected signal line (Sig23) and its adjacent signal line (Sig24) in the n+1th frame when the writing order is changed between the nth frame and the n+1th frame. A lower side of FIG. 38 shows voltage waveforms of respective pixels connected to the signal line (Sig23).

FIG. 39A relatively shows effective potentials of the respective pixels in the nth frame. FIG. 39B relatively shows effective potentials of the respective pixels in the n+1th frame when the nth frame and the n+1th frame have the same writing order. FIG. 39C shows average effective potentials of the nth frame and the n+1th frame.

FIG. 40A relatively shows effective potentials of the respective pixels in the nth frame. FIG. 40B relatively shows effective potentials of the respective pixels in the n+1th frame when the writing order is changed between the nth frame and the n+1th frame. FIG. 40C shows average effective potentials of the nth frame and the n+1th frame.

DESCRIPTION OF THE EMBODIMENTS

First Embodiment

Figure 1:
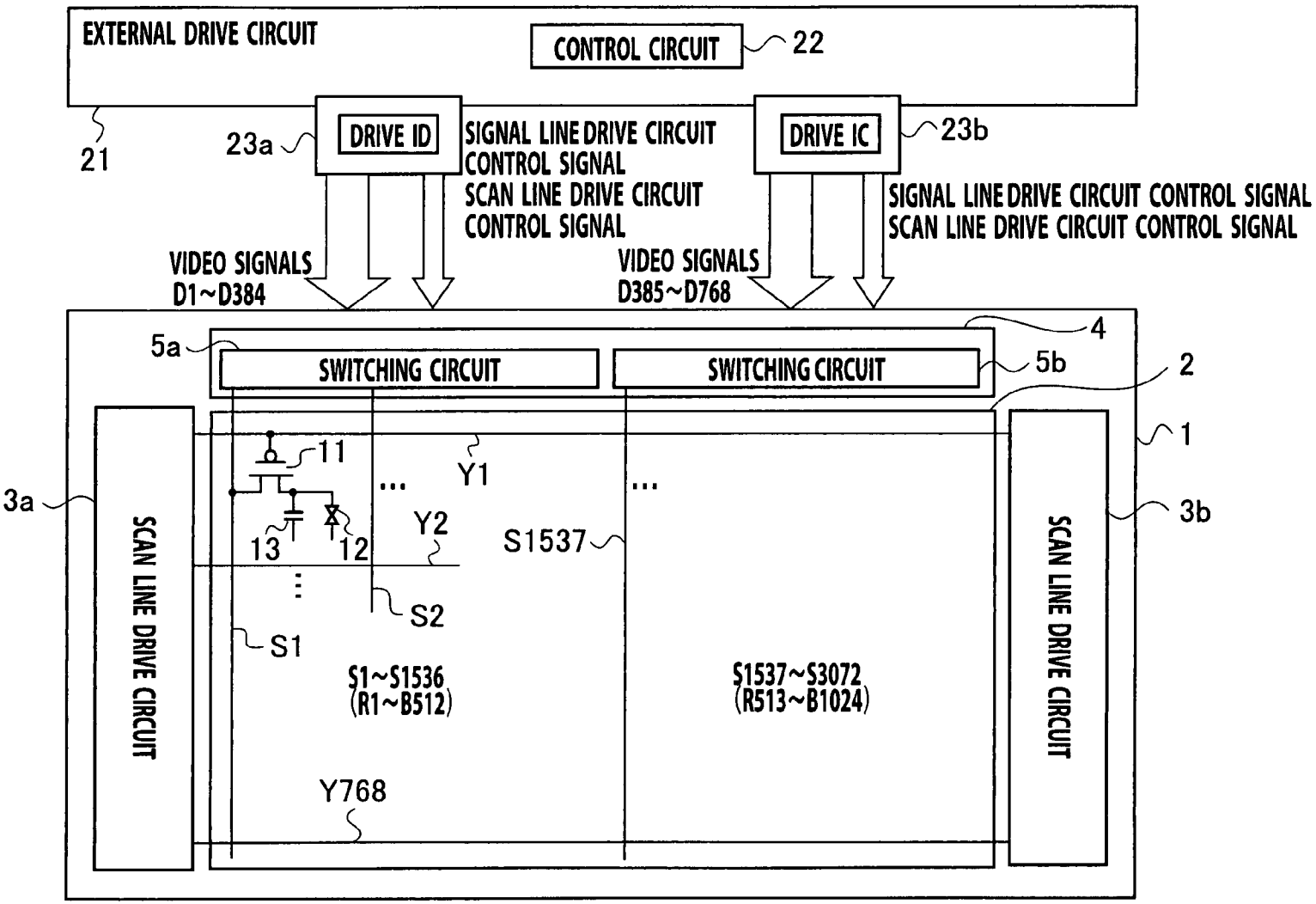
FIG. 1 is a circuit block diagram schematically showing a configuration of a liquid crystal display device according to one embodiment.

As shown in a circuit block diagram of FIG. 1, a liquid crystal display device of this embodiment includes, a pixel display part 2 on a glass array substrate 1; scan line drive circuits 3*a* and 3*b* which are disposed at both left and right ends of the pixel display part 2; and a signal line drive circuit 4 which is disposed at an upper end of the pixel display part 2. In addition, the liquid crystal display device includes an external drive circuit 21 and drive ICs 23*a* and 23*b* outside the array substrate 1.

In the pixel display part 2, a plurality of scan lines Y1 to Y768 from the scan line drive circuits 3 and a plurality of signal lines S1 to S3072 from the signal line drive circuit 4 are arranged so as to intersect with each other. At respective intersections, pixels, each including a thin film transistor 11, a liquid crystal capacity 12 and an auxiliary capacity 13, are disposed. The thin film transistor 11 is, for example, a MOS-TFT, which has its drain terminal connected to the liquid crystal capacity 12 and the auxiliary capacity 13, has its source terminal connected to the signal line S and has its gate terminal connected to the scan line Y.

Here, a XGA display panel is assumed as an example. Specifically, the pixel display part 2 includes 1024×3(RGB)=3072 signal lines, 768 scan lines and 1024×3(RGB)×768 pixels.

The scan line drive circuits 3 drive the scan lines Y1 to Y768, respectively. The signal line drive circuit 4 drives the signal lines S1 to S3072, respectively. The signal line drive circuit 4 includes switching circuits 5*a* and 5*b*. The switching circuit 5*a* drives the signal lines S1 to S1536 and the switching circuit 5*b* drives the signal lines S1537 to S3072.

The external drive circuit 21 generates scan line drive circuit control signals for controlling the scan line drive circuits 3*a* and 3*b* and signal line drive circuit control signals for controlling the switching circuits 5*a* and 5*b* in the signal line drive circuit 4, and transmits these control signals to the scan line drive circuits 3*a* and 3*b* and the switching circuits 5*a* and 5*b*, respectively, through the drive ICs 23*a* and 23*b*. Moreover, the external drive circuit 21 transmits video signals to the switching circuits 5*a* and 5*b*, respectively, through the drive ICs 23*a* and 23*b*.

The scan line drive circuit control signal described above includes a start pulse and a clock pulse. The signal line drive circuit control signal includes switch control signals ASW1U, ASW2U, ASW3U and ASW4U for controlling the switching circuits 5*a* and 5*b*. These control signals are generated by a control circuit 22 in the external drive circuit 21.

The drive ICs 23*a* and 23*b* have TCPs mounted thereon by use of a TAB method. Respective video output lines from the drive ICs 23*a* and 23*b* are connected to the respective signal lines via the switching circuits 5*a* and 5*b*.

For each group in which each of the video output lines corresponds to N signal lines (N is an integer of 3 or more), each of the switching circuits 5*a* and 5*b* selects a signal line to be connected to the video output line among the N signal lines and switches and connects the signal line to the video output line.

In this embodiment, the value of N is assumed to be 4 as an example. In this case, 4 signal lines are switched thereamong for each video output line and connected to the video output line. Thus, the number of video output lines is ¼ of the number of signal lines. As to the switching circuit 5*a*, 384 video output lines are required for 1536 signal lines. Thus, in the whole XGA display panel having 3072 signal lines, only 2 of the drive ICs 23, each having 384 output terminals of video output lines, are required.

If such a switch connection as described above is not performed, 3072/384=8 of the same drive ICs are required. On the other hand, the liquid crystal display device of this embodiment requires only 2 of the drive ICs. Thus, the scale thereof can be significantly reduced.

The drive IC 23*a* transmits video signals D1 to D384 to the switching circuit 5*a*. The drive IC 23*b* transmits video signals D385 to D768 to the switching circuit 5*b*.

Figure 2:
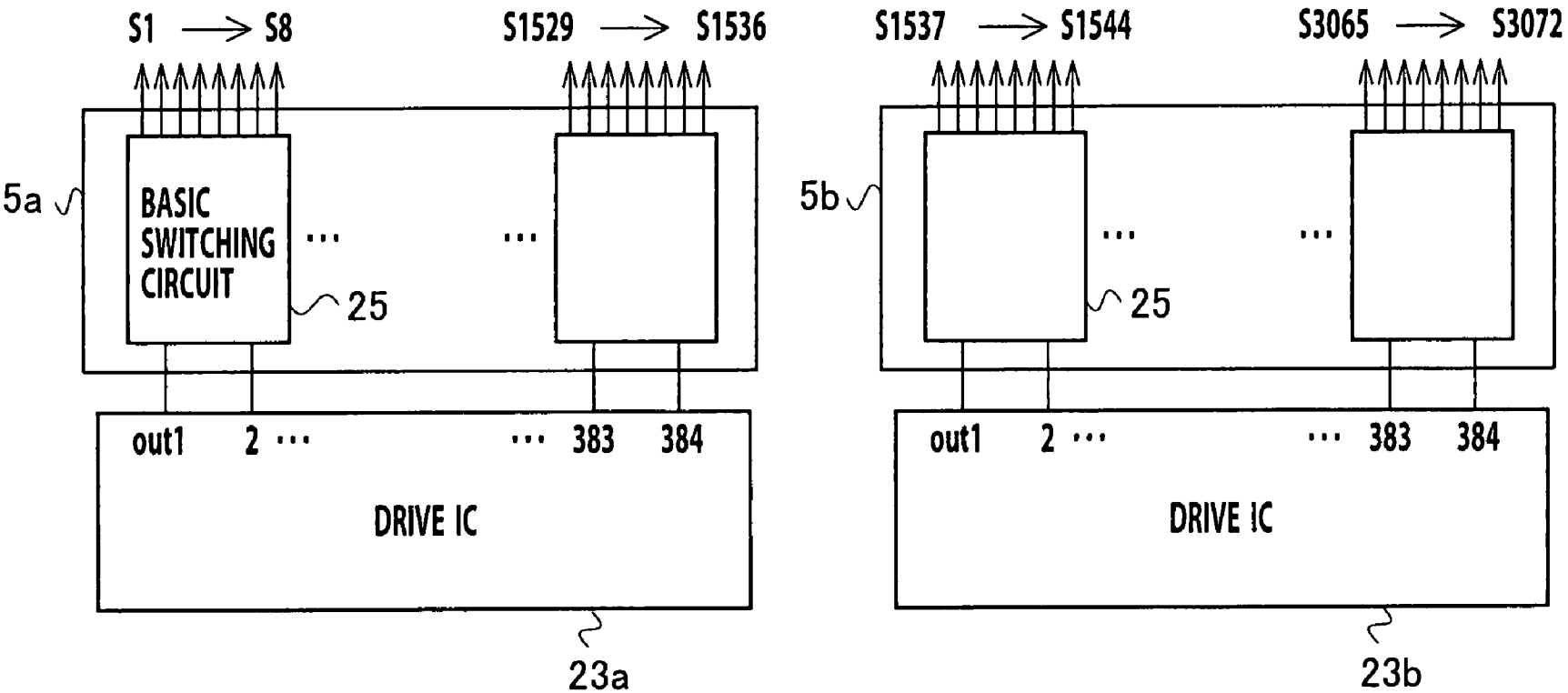
FIG. 2 shows a block diagram of drive ICs and switching circuits in the foregoing liquid crystal display device.

As shown in a circuit block diagram of FIG. 2, the switching circuits 5*a* and 5*b* include basic switching circuits 25, each of which corresponds to 2 of the video output lines. Specifically, each of the switching circuits 5*a* and 5*b* includes 384/2=192 of the basic switching circuits 25.

Figure 3:
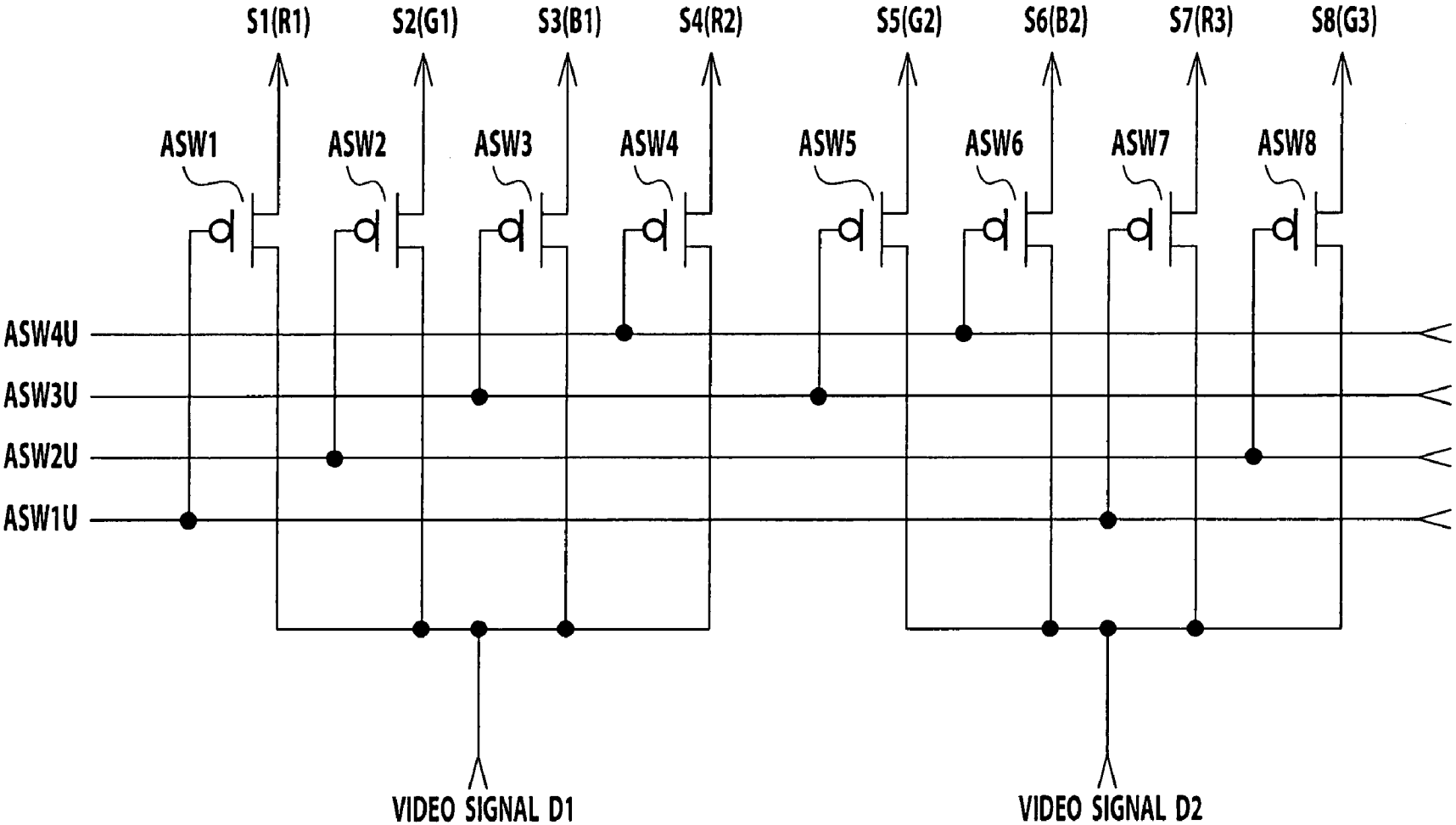
FIG. 3 shows a circuit diagram of a basic switching block in the foregoing switching circuit.

As shown in a circuit diagram of FIG. 3, in the basic switching circuit 25 to which the video signals D1 and D2 are inputted, the video output line transmitting the video signal D1 is branched off into 4 lines. The video output lines are connected to the signal lines S1 to S4 via analog switches ASW1 to ASW4, respectively. Here, the signal lines S1 to S4 are called a first group.

Similarly, the video output line transmitting the video signal D2 is also branched off into 4 lines. The video output lines are connected to the signal lines S5 to S8 via analog switches ASW5 to ASW8, respectively. Here, the signal lines S5 to S8 are called a second group A control line transmitting the switch control signal ASW1U is connected to respective gate terminals of the analog switches ASW1 and ASW7. A control line of the switch control signal ASW2U is connected to respective gate terminals of the analog switches ASW2 and ASW8. A control line of the switch control signal ASW3U is connected to respective gate terminals of the analog switches ASW3 and ASW5. A control line of the switch control signal ASW4U is connected to respective gate terminals of the analog switches ASW4 and ASW6.

All of the analog switches ASW1 to ASW8 are p-channel TFTs. When the switch control signal ASW1U has a low potential, ASW1 and ASW7 are turned on and video signals are supplied to the signal lines S1 and S7. When the switch control signal ASW2U has a low potential, ASW2 and ASW8 are turned on and video signals are supplied to the signal lines S2 and S8. When the switch control signal ASW3U has a low potential, ASW3 and ASW5 are turned on and video signals are supplied to the signal lines S3 and S5. When the switch control signal ASW4U has a low potential, ASW4 and ASW6 are turned on and video signals are supplied to the signal lines S4 and S6. The other basic switching circuits have the same configuration as that described above.

Next, description will be given of a method for driving the signal lines. In a method for selecting and driving a signal line, when a video signal is supplied to a selected signal line, the video signal changes a potential of an adjacent signal line in a floating state where no video signal is propagated through coupling capacities between its own pixel and its own signal line, between its own pixel and an adjacent signal line and between its own signal line and the adjacent signal line, respectively. Thus, there is a problem that there occurs a difference in write potentials into pixels for each signal line and uneven display occurs.

Accordingly, in order not to cause such uneven display in writing, this embodiment focuses attention on that, when a polarity of a video signal supplied to a signal line is inverted, an adjacent signal line is affected by a potential change and, when the polarity of the video signal is not inverted, the adjacent signal line is not affected by the potential change.

To be more specific, in writing video signals into respective pixels of an Lth (L is an integer of 1 or more) scan line via signal lines, for each group in which one video output line corresponds to N signal lines, the control circuit 22 controls an order of selecting the signal lines so as to select first a signal line to which a video signal having its polarity inverted between an L−1th line and the Lth line is supplied and select later a signal line to which a video signal having its polarity not inverted between the L−1th line and the Lth line is supplied.

Specifically, the signal line having its polarity not inverted is selected later so that a signal line in a floating state where writing is finished is not affected by a potential change of an adjacent signal line in writing.

An example of the control method described above will be described below. Here, a 2H2V inversion drive method is taken for example, in which the value of N is assumed to be 4, polarities of video signals supplied to signal lines every 2 horizontal scan periods are switched and a video signal having its polarity inverted in every third line is supplied to an adjacent signal line.

Figure 4:
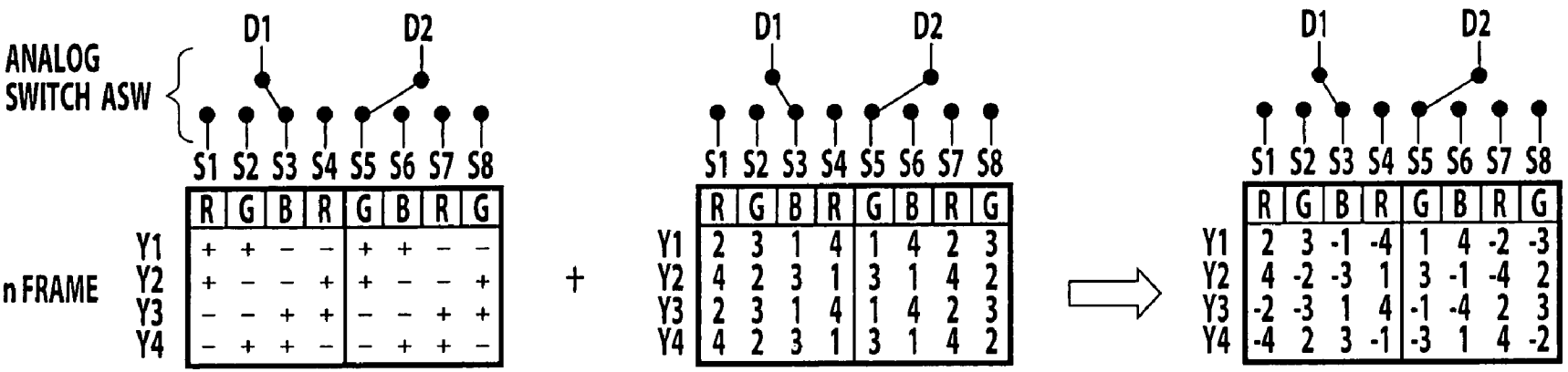
FIG. 4 shows polarities of video signals and selection orders of signal lines in respective pixels of an nth frame as to a 2H2V inversion drive method for selection of four signal lines.

As shown in a view on the left side in FIG. 4, as to an nth frame (n is a positive integer), polarities of respective pixels in a column of the signal line S1 to which the video signal D1 is supplied are in the order of (++−−++−− . . . ) from Y1 to Y4 and the polarities of the respective pixels are inverted every 2 horizontal scan periods. Polarities of respective pixels in a column of the signal line S2 are in the order of (+−−++−−+ . . . ), polarities of respective pixels in a column of the signal line S3 are in the order of (−−++−−++ . . . ) and polarities of respective pixels in a column of the signal line S4 are in the order of (−++−−++− . . . ). All of the polarities of the respective pixels described above are inverted every 2 horizontal scan periods.

In the driving method of this embodiment, one horizontal scan period is divided into 4 selection periods and two groups having different orders of selecting signal lines from each other are provided. Accordingly, the control circuit 22 generates the switch control signals ASW1U to ASW4U for sequentially turning on four analog switches ASW in each of the groups.

In FIG. 4, as to the respective pixels of the scan line Y2, in comparison with the respective pixels of the scan line Y1, the polarities are inverted in the signal lines S2, S4, S6 and S8 and the polarities are not inverted in the signal lines S1, S3, S5 and S7.

Accordingly, as to a first group, the signal lines S2 and S4 in which the polarities are inverted are selected first and, thereafter, the signal lines S1 and S3 are selected. As to a second group, the signal lines S6 and S8 in which the polarities are inverted are selected first and, thereafter, the signal lines S5 and S7 are selected. Although each of the groups has two signal lines to be selected first, either one of the two signal lines may be selected first. Similarly, the order of selection is also arbitrary for the two signal lines to be selected later.

Here, as shown in a view in the middle of FIG. 4, as to the scan line Y2, the signal lines S4 and S6 are selected in a first selection period when one horizontal scan period is divided into 4 periods, the signal lines S2 and S8 are selected in a second selection period, the signal lines S3 and S5 are selected in a third selection period and the signal lines S1 and S7 are selected in a fourth selection period. Thus, in the basic analog switch blocks shown in FIG. 3, the control circuit 22 sets the switch control signal ASW4U to have a low potential in the first selection period, sets the switch control signal ASW2U to have a low potential in the second selection period, sets the switch control signal ASW3U to have a low potential in the third selection period and sets the switch control signal ASW1U to have a low potential in the fourth selection period.

The polarity of the video signal D2 is opposite to that of the video signal D1. Meanwhile, switching of the signal lines S1 to S4 and S5 to S8 by the analog switches ASW is simultaneously performed between S4 and S6, between S2 and S8, between S3 and S5 and between S1 and S7, respectively. Thus, as shown in the view on the left side in FIG. 4, the polarities of the pixels in the respective columns of the signal lines S5 to S8 are the same as those of the pixels in the respective columns of the signal lines S1 to S4. Note that, as shown in a view on the right side in FIG. 4, the polarities of the respective pixels and the orders of selecting the signal lines are summarized.

Here, assumed is half-tone raster display such that a potential of positive polarity is 7V and a potential of negative polarity is 3V. When attention is focused on the row of the scan line Y2 in FIG. 4, in the first group, the signal line S4 is selected in the first selection period and the potential of the signal line changes from 3V to 7V. Under the influence of this change, the potentials of the adjacent signal lines S3 and S5 in a floating state also change. When the signal line S2 is selected in the second selection period, the potential of the signal line S2 changes from 7V to 3V. Under the influence of this change, the potentials of the adjacent signal lines S1 and S3 in a floating state also change. When the signal line S3 is selected in the third selection period, the potential of the signal line S3 does not change from 3V. Thus, the adjacent signal lines S2 and S4 in the floating state at this time are not influenced by the potential change. This signal line S3 is influenced by the potential change of the signal line S4 in the first selection period. However, since video signals are newly written into pixels in the third selection period, the influence of the potential change in the first selection period is not left. Finally, when the signal line S1 is selected in the fourth selection period, the potential of the signal line S1 does not change from 7V. Thus, the adjacent signal line S2 in the floating state is not influenced by the potential change. The signal line S1 is influenced by the potential change of the signal line S2 in the second selection period. However, since video signals are newly written into pixels in the fourth selection period, the influence of the potential change in the second selection period is not left.

As described above, the signal lines having the polarities inverted are selected first and second and the signal lines having the polarities not inverted are selected third and fourth. Accordingly, the video signals can be written into the pixels without influence of the potential change on all of the signal lines. Note that, here, the description was given by taking the scan line Y2 of the second row for example. However, the same goes for all the other rows.

Figure 5:
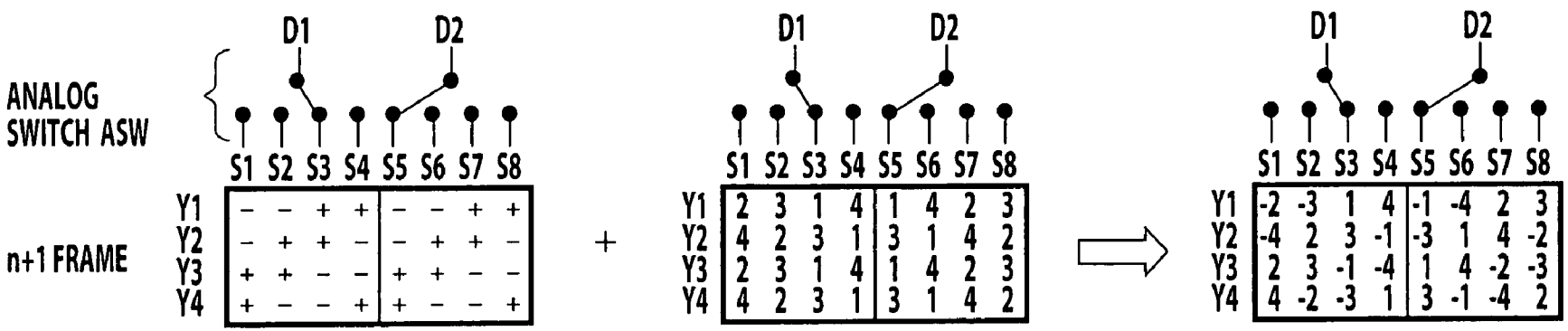
FIG. 5 shows polarities of video signals and selection orders of signal lines in respective pixels of an n+1th frame as to the 2H2V inversion drive method for selection of four signal lines.

FIG. 5 shows polarities of respective pixels and an order of selecting signal lines as to an n+1th frame, as in the case of FIG. 4. In the n+1th frame, although the polarities of the respective pixels are opposite to those of the respective pixels in the nth frame, the order of selecting signal lines is the same as that of the nth frame.

Figure 6:
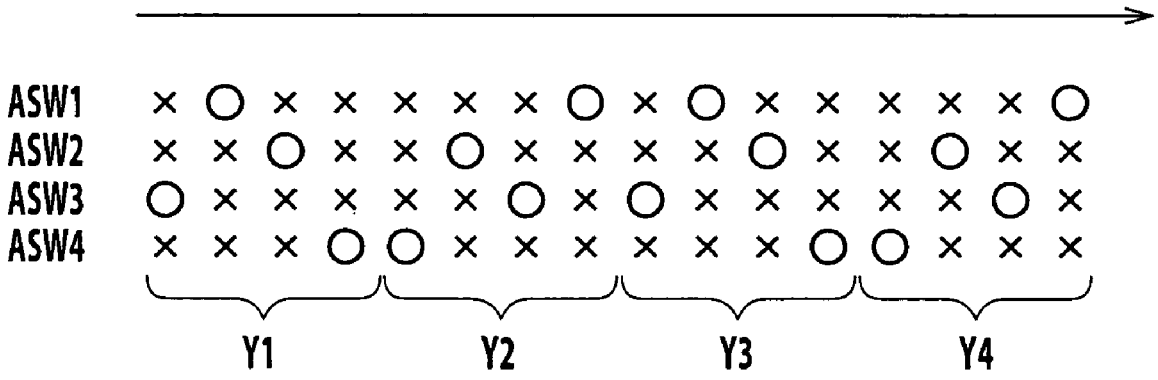
FIG. 6 shows on and off states of respective analog switches along with the passage of time for each of scan lines.

FIG. 6 is a view in which on and off states of the respective analog switches ASW1 to ASW4 are summarized for each of the scan lines. The circle marks in FIG. 6 indicate the on states of the analog switches ASW and the cross marks indicate the off states thereof. For example, in the scan line Y2, as described above, the analog switches are sequentially turned on in the order of ASW4, ASW2, ASW3 and ASW1. The same goes for the nth frame and the n+1th frame.

Therefore, according to this embodiment, for each of the groups in which one video output line corresponds to N signal lines, the selected signal lines are sequentially connected to the video output line via the analog switches ASW. Accordingly, the number of the video output lines is reduced to 1/N. Thus, the scale of the drive ICs 23 can be reduced. Consequently, cost reduction and low power consumption can be achieved.

According to this embodiment, as to the Lth scan line, in each of the groups, the signal line to which the video signal having its polarity inverted between the L−1th line and the Lth line is supplied is selected first and the signal line to which the video signal having its polarity not inverted therebetween is supplied is selected later. Thus, the video signal having the polarity not inverted and having no potential change is supplied to the signal line later. Accordingly, the video signals can be written into the pixels without influence of the potential change on all of the signal lines. Thus, uneven display can be prevented and a liquid crystal display device capable of high-quality image display can be realized.

Figure 7:
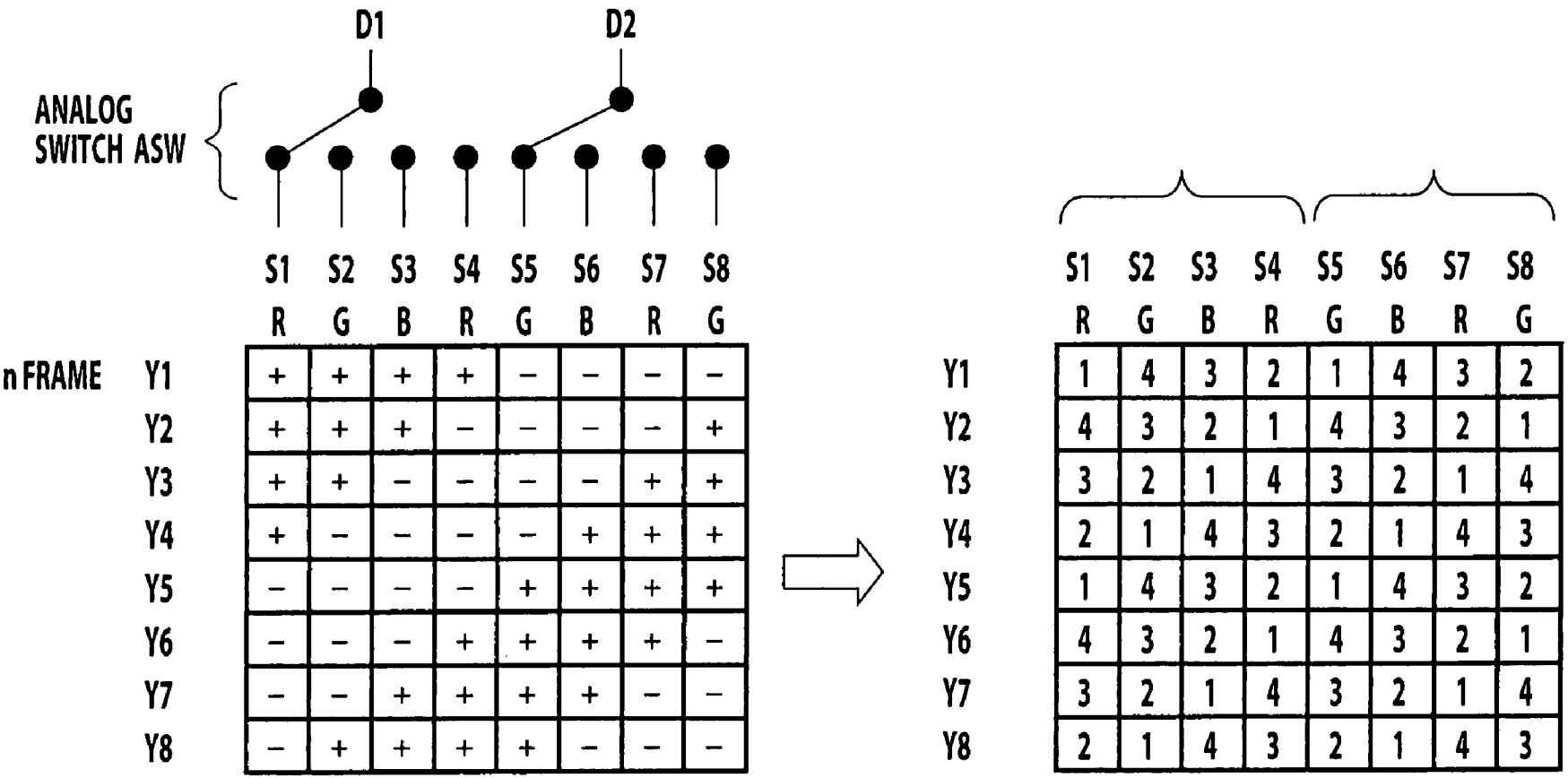
FIG. 7 shows polarities of video signals and selection orders of signal lines in respective pixels of the nth frame as to a 4H4V inversion drive method for selection of four signal lines.
Figure 8:
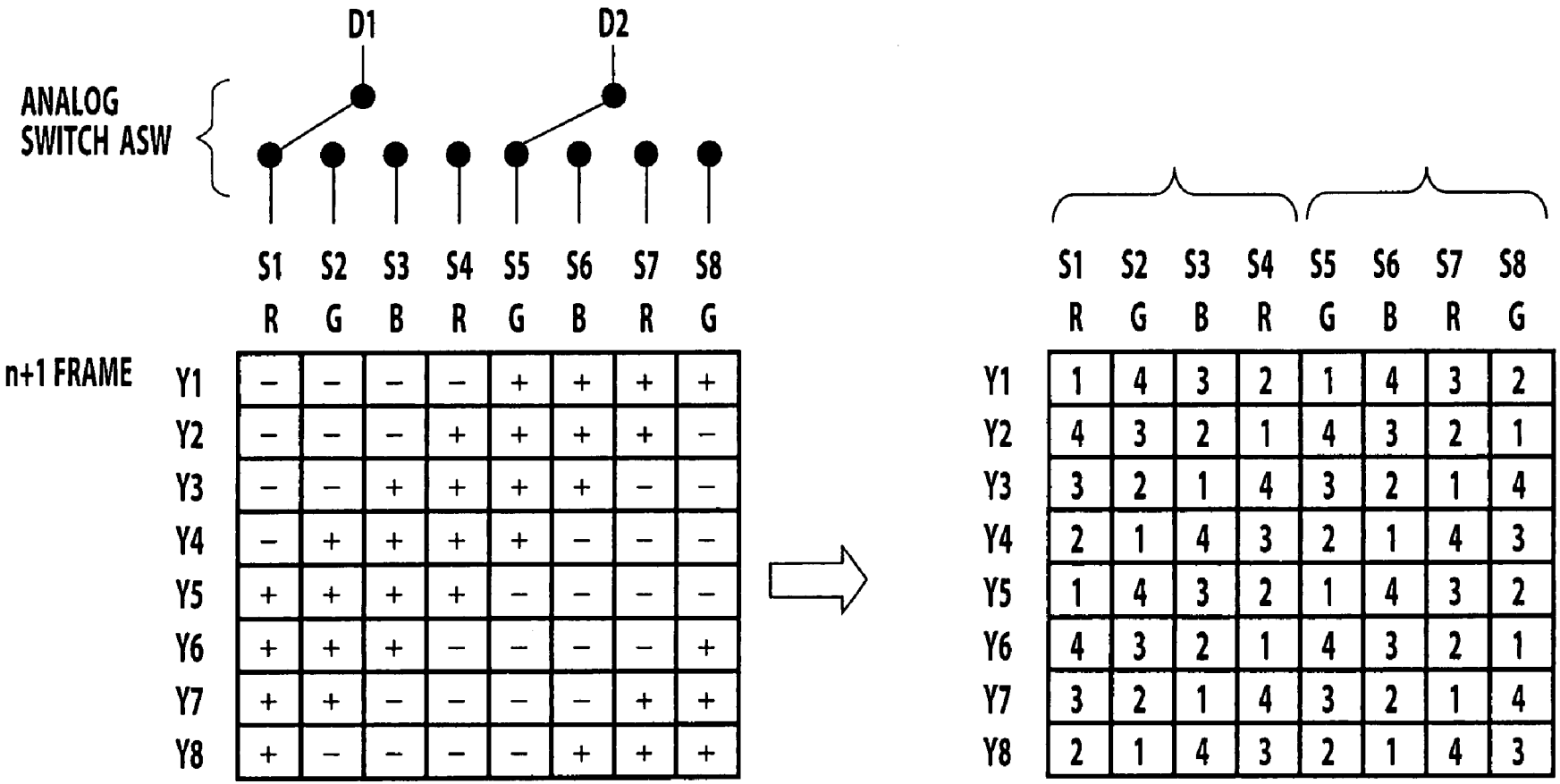
FIG. 8 shows polarities of video signals and selection orders of signal lines in respective pixels of the n+1th frame as to the 4H4V inversion drive method for selection of four signal lines.

Note that, in this embodiment, the 2H2V inversion drive method for selection of 4 signal lines is adopted. However, the method is not limited thereto. For example, as shown in the nth frame of FIG. 7 and the n+1th frame of FIG. 8, a 4H4V inversion drive method for selection of 4 signal lines may be adopted, in which the value of N is assumed to be 4, polarities of video signals supplied to signal lines every 4 horizontal scan periods are switched and a video signal having a polarity of the signal line inverted in every fifth line is supplied. In this case, the uneven display can be also prevented as in the case described above by selecting first a signal line to which a video signal having its polarity inverted is supplied and selecting later a signal line to which a video signal having its polarity not inverted is supplied.

Moreover, by controlling the selection order as described above, even in the case of adopting a 2H2V, 3H3V, 4H4V or 6H6V inversion drive method for selection of 12 signal lines, for example, the uneven display can be similarly prevented. Furthermore, by use of the selection order as described above, even in the case of adopting a mHmV inversion drive method for selection of N signal lines (m is a submultiple of N exclusive of 1), the uneven display can be similarly prevented.

Moreover, although the description was given of the XGA display panel in this embodiment, the present invention is not limited thereto. The present invention can be similarly applied to a display panel other than the XGA display panel, such as a SXGA display panel and a UXGA display panel, for example.

Second Embodiment

As described in the first embodiment, in the case of supplying a video signal by switching the video signal to a plurality of signal lines in one horizontal scan period, the larger the number of signal lines is, the shorter the time for supplying the video signal to each of the signal lines (hereinafter referred to as write time) becomes. Thus, selection of the signal lines is terminated before write of a desired analog potential into pixels through the signal lines is finished. Accordingly, write deficiency into pixels may occur.

There are two factors causing the write deficiency, including: (i) polarity inversion of a video signal between the L−1th line and the Lth line (hereinafter referred to as "polarity inversion in a vertical direction"); and (ii) polarity inversion of a video signal between a signal line selected to be an S−1th (S is an integer of 1 or more) and a signal line selected to be an Sth (hereinafter referred to as "polarity inversion in a horizontal direction").

Thus, as to a difficulty level in writing an analog potential of a video signal into a selected signal line, there are four difficulty levels as below by combination of the factors (i) and (ii).

(A) The most difficult condition to write is a case when polarities are inverted in both the vertical direction and the horizontal direction. (B) The second most difficult condition is a case when the polarities are inverted only in the vertical direction. (C) The third most difficult condition is a case when the polarities are inverted only in the horizontal direction. (D) The easiest condition to write is a case when the polarities are not inverted in both the vertical direction and the horizontal direction.

An upper table of FIG. 9 shows orders of selecting signal lines in one horizontal scan period and polarities of video signals. In a lower table of FIG. 9, the four write conditions (A) to (D) described above are applied based on the selection orders and the polarities of the video signals in the upper table. For example, when attention is focused on a pixel of a second row in G1 line, in the vertical direction, a polarity of a video signal is inverted to be a negative polarity in the second row from a positive polarity written in a first row. Meanwhile, in the horizontal direction, the polarity of the video signal is inverted from a positive polarity of a second row in R2 line to the negative polarity of the second row in G1 line. Thus, the write condition of this pixel is (A).

Similarly, the write conditions of all the pixels can be expressed as shown in the lower table of FIG. 9. Here, considering the case of Green raster display, for example, the following is found out. Specifically, in FIG. 9, while G1 line and G3 line have the same write conditions, the most difficult condition (A) of all the write conditions is not included in G2 line.

In the order of writing as shown in FIG. 9, when no write deficiency is caused under all of the write conditions (A) to (D), there is no problem of display. However, if write deficiency is caused only under the most difficult condition (A) of all the write conditions, there occurs a difference in a liquid crystal effective potential between G2 line and G1 line and between G2 line and G3 line. Thus, there arises a problem that the difference becomes visible easily as unevenness.

Accordingly, in this embodiment, description will be given of a liquid crystal display device in which such visible unevenness is prevented. Note that, a basic configuration of the liquid crystal display device of this embodiment is similar to that of the first embodiment. Thus, here, repetitive description will be omitted and only an operation of the control circuit 22, which is a difference between the first and second embodiments, will be described.

When attention is focused on the second row in the upper table of FIG. 9, in the first embodiment, signal lines R2 line and G1 line, to which a video signal having a polarity inverted between the first and second rows is supplied, are selected first in this order. Thereafter, signal lines B1 line and R1 line, to which a video signal having a polarity not inverted is supplied, are selected in this order. As to this order of selection, the same goes for the fourth row in which the same pattern of polarity inversion is repeated.

Meanwhile, the control circuit 22 of the liquid crystal display device in this embodiment controls the selection order of signal lines to be selected first in each group as well as the selection order of signal lines to be selected later in such a manner that write conditions are distributed evenly across the entire display screen. Specifically, the write conditions are related to presence of polarity inversion of a video signal between the L−1th line and the Lth line and presence of polarity inversion of a video signal between a signal line selected to be the S−1th (S is an integer of 1 or more) and a signal line selected to be the Sth.

Specifically, as shown in an upper table of FIG. 10, signal lines G1 line and R2 line, to which a video signal having a polarity inverted between the first and second rows is supplied, are selected first in this order. Thereafter, signal lines R1 line and B1 line, to which a video signal having a polarity not inverted is supplied, are selected in this order. In this case, in the fourth row in which the same pattern of polarity inversion is repeated, the selection order of the signal lines to be selected first is changed to the order of R2 line and G1 line. At the same time, the selection order of the signal lines to be selected later is changed to the order of B1 line and R1 line. Similarly, also as to the third row, the selection order of a plurality of signal lines selected first in the first row is changed and the selection order of a plurality of signal lines selected later is changed.

The other rows are similarly controlled. Furthermore, the other groups are controlled similarly to the group described above.

In such an order of writing as described above, the case of Green raster display is considered. As shown in a lower table of FIG. 10, write conditions of G1, G2 and G3 lines include the same numbers of the conditions (A) to (D), respectively. Thus, even if write deficiency is caused only under the condition (A), all the lines have the same write conditions. As a result, the write deficiency becomes hard to be visible as unevenness.

Therefore, according to this embodiment, all the signal lines have the same write conditions by controlling the selection order of the plurality of signal lines to be selected first in each group as well as the selection order of the plurality of signal lines to be selected later in such a manner that write conditions in respective pixels are distributed evenly across the entire display screen. Specifically, the write conditions are related to presence of polarity inversion of the video signal between the L−1th line and the Lth line and presence of polarity inversion of the video signal between the S−1th line and the Sth line in respective signal lines. Thus, it is possible to make unevenness caused by the write deficiency hard to be visible.

Third Embodiment

As shown in an equivalent circuit of FIG. 11, each pixel is connected to its own signal line S1 via a coupling capacity Cp1 and is connected to an adjacent signal line S2 via a coupling capacity Cp2. Moreover, each pixel is connected to pixels positioned thereabove and therebelow via coupling capacities Cp3. In FIG. 11, Clc is a liquid crystal capacity and Ccs is an auxiliary capacity.

A potential change amount which each pixel electrode receives via the coupling capacity Cp1 due to a potential change dVsig_m (sig_m is the number of a signal line) of the own signal line S1 is assumed to be Vs. A potential change amount which each pixel electrode receives via the coupling capacity Cp2 due to a potential change dVsig_m+1 of the adjacent signal line S2 is assumed to be Vn. A potential change amount which each pixel electrode receives via the coupling capacity Cp3 due to a potential change dVpix of a lower pixel is assumed to be Vv. At this time, Vs, Vn and Vv can be expressed as below.

$$Vs=(Cp1/C\text{total})\times dV\text{sig_}n \quad (1)$$

$$Vn=(Cp2/C\text{total})\times dV\text{sig_}n+1 \quad (2)$$

$$Vv=(Cp3/C\text{total})\times dV\text{pix} \quad (3)$$

$$C\text{total}=Cp1+Cp2+2Cp3+Clc+Ccs$$

FIG. 12 is a view showing polarities of respective pixels and orders of selecting signal lines in the nth frame when R (red), G (green) and B (blue) are considered. In FIG. 12, attention is focused on the signal line of G1 line, for example, when the signal lines of R1, G1, B1 and R2 are assumed to be one group. At this time, G1 line is selected in the first selection period of one horizontal scan period of the row b and a video signal of negative polarity is supplied thereto. Thereafter, the selection of G1 line is released and the supplied negative potential is maintained in a floating state in G1 line until the fourth selection period in one horizontal scan period of the row c. Subsequently, G1 line is selected again in the fourth selection period of the row c and a video signal of negative polarity is supplied thereto. Thereafter, the selection of G1 line is released, G1 line is selected again in the second selection period of the row d, and a video signal of positive polarity is supplied thereto this time. This positive potential is maintained in G1 line until a video signal of positive polarity is supplied again in the third selection period of the row e and a video signal of negative polarity is supplied in the first selection period of subsequent one horizontal scan period (the row f (the same as the row b); not shown). Assuming that the above is one cycle, video signals of positive and negative polarities are supplied to G1 line.

At this time, timing for polarity inversion of the video signals to be supplied to G1 line is the first selection period in the row b, for example. Meanwhile, in the row d, the timing is the second selection period. In such a manner, since the timings are different within one horizontal scan period, there occurs a variation of polarity in potentials of signal lines. Specifically, in G1 line, while a period of positive potential is 7, a period of negative potential is 9. As shown in FIG. 11, a pixel potential during a maintaining period is changed by potential changes of adjacent signal lines on both sides via the respective coupling capacities. Thus, when there occurs the above-described variation of polarity in potentials of the signal lines, a variation also occurs in voltages retained by the pixels. This variation in voltages becomes a difference in effective voltages applied to liquid crystal. As a result, there arises a problem that the difference is visible as uneven display.

Accordingly, in this embodiment, description will be given of a liquid crystal display device in which such visible unevenness is prevented. Note that, a basic configuration of the liquid crystal display device of this embodiment is similar to that of the first embodiment and is different therefrom only in the selection order of signal lines in the control circuit 22. Thus, here, repetitive description will be omitted and only a difference in operations by the control circuit 22 will be described.

An upper side of FIG. 13 shows voltage waveforms indicating potential behavior of a selected signal line (Sig2) and its adjacent signal line (Sig3) in the nth frame. A lower side of FIG. 13 shows voltage waveforms of pixels a2, b2, c2 and d2 which are connected to the signal line (Sig2). Potentials of these pixels are changed under influence of potential changes of the own signal line (the selected signal line Sig2) and the adjacent signal line (Sig3). Note that, in FIG. 13, Green raster display is assumed and attention is focused on potential retaining behavior of green pixels.

As shown in the upper side of FIG. 13, into the signal line (Sig2), a video signal of positive polarity is written in the first horizontal scan period (shown as "1H" in FIG. 13), a video signal of negative polarity is written from the beginning of the second horizontal scan period to the end of the first selection period of the fourth horizontal scan period, and a video signal of positive polarity is written from the beginning of the second selection period of the fourth horizontal scan period to the end of the fifth horizontal scan period. Meanwhile, into the signal line (Sig3), a video signal of negative polarity is written from the beginning of the first horizontal scan period to the end of the first selection period of the third horizontal scan period, a video signal of positive polarity is written from the beginning of the second selection period of the third horizontal scan period to the end of the fourth horizontal scan period, and a video signal of negative polarity is written from the beginning of the fifth horizontal scan period to the end of the first selection period of the seventh horizontal scan period.

Next, time charts of the respective pixels a2, b2, c2 and d2 on G1 line (Sig2) will be described. Note that, black triangle marks on the time charts of FIG. 13 indicate timing for the pixels to enter a retaining period and the end of one cycle of retaining behavior. Particularly, downward black triangle marks indicate that write potentials of positive polarity are retained and upward black triangle marks indicate that write potentials of negative polarity are retained.

When attention is focused on the pixel a2 of the row a in G1 line (Sig2), in the pixel a2, an analog voltage level Vp.a2 of a video signal of positive polarity is written in the third selection period of the first horizontal scan period (1H). The pixel a2 enters the retaining period after the end of 1H.

In the first selection period of the second horizontal scan period (2H), since the potential of Sig2 shifts from positive to negative, the potential of the pixel a2 shifts downward by Vs. In the first selection period of 2H, a negative video signal potential is written into the pixel b2 positioned under the pixel a2 and the potential of the pixel b2 shifts from a positive potential retained in the n−1th frame to a negative potential. Thus, under the influence of this shift, the potential of the pixel a2 shifts downward by the potential Vv. The pixel a2 retains this potential until the end of the first selection period of 3H.

In the second selection period of the third horizontal scan period (3H), since the potential of the adjacent signal line Sig3 shifts from negative to positive, the potential of the pixel a2 shifts upward by Vn. The pixel a2 retains this potential until the end of the first selection period of 4H.

In the second selection period of the fourth horizontal scan period (4H), since the potential of the own signal line Sig2 shifts from negative to positive, the potential of the pixel a2 shifts upward by Vs. The pixel a2 retains this potential until the end of 4H.

In the first selection period of the fifth horizontal scan period (5H), since the potential of the adjacent signal line Sig3 shifts from positive to negative, the potential of the pixel a2 shifts downward by Vn. The pixel a2 retains this potential until the end of 5H.

Assuming that the above is one cycle, the pixel a2 retains the potential during one horizontal scan period until a video signal is written into the pixel a2 in the next frame.

In consideration of the written video signal potential Vp.a2 and the behavior in the retaining period described above, an effective potential (Vp_a2)eff of the pixel a2 can be expressed as in the following equation.

$$(Vp_a2)eff=(Vp.a2-V\mathrm{com})+7/16Vn-9/16Vs-Vv \quad (4)$$

Similarly, effective potentials (Vp_b2)eff, (Vp_c2)eff and (Vp_d2)eff of the other pixels b2, c2 and d2 can be expressed by the following equations, respectively.

$$(Vp_b2)eff=(V\mathrm{com}-Vp.b2)-7/16Vn-7/16Vs+Vv \quad (5)$$

$$(Vp_c2)eff=(V\mathrm{com}-Vp.c2)+9/16Vn-7/16Vs-Vv \quad (6)$$

$$(Vp_d2)eff=(Vp.d2-V\mathrm{com})-9/16Vn-9/16Vs+Vv \quad (7)$$

The respective equations (4) to (7) are shown in an upper right portion of FIG. 13 for confirmation. Here, the potential in parentheses of the first term of the right-hand side in each equation expresses a liquid crystal applied voltage in writing and the second term and subsequent terms of the right-hand side express potential changes received in retaining. Since the first term of the right-hand side is the same if raster display is assumed, the following equation is established.

$$Vpw=(Vp\cdot a2-Vcom)=(Vcom-Vp\cdot b2)$$
$$=(Vcom-Vp\cdot c2)=(Vp\cdot d2-Vcom)$$

Effective potential differences between the pixels positioned above and below are as shown in a lower right portion of FIG. 13. For example, the effective potential difference dVa_b between the pixels a2 and b2 is obtained by the following equation.

$$dVa_b=(Vp_a2)eff-(Vp_b2)eff$$
$$=7/8Vn-1/8Vs-2Vv$$

The effective potential differences of the other pixels positioned above and below can be similarly obtained.

Similarly, effective potentials of all the green pixels in the nth frame can be obtained by the equations in the respective upper right portions of FIGS. 14 to 20.

Incidentally, the coupling capacities Cp1, Cp2 and Cp3 shown in FIG. 11 are capacities determined based on the pixel structure. Here, assuming that Cp1=Cp2 and Cp3=0, Vs=Vn and Vv=0 are established based on the equations (1) to (3). If the equations (4) to (7) are rewritten by use of the equations described above, the effective potentials of the respective pixels can be expressed as below.

$$(Vp_a2)eff=Vpw-1/8Vs \quad (8)$$

$$(Vp_b2)eff=Vpw-7/8Vs \quad (9)$$

$$(Vp_c2)eff=Vpw+1/8Vs \quad (10)$$

$$(Vp_d2)eff=Vpw-9/8Vs \quad (11)$$

Here, the case where the effective potential of the pixel is not changed, the case where the effective potential is somewhat increased, the case where the effective potential is somewhat reduced, and the case where the effective potential is reduced are relatively defined as "0", "1", "−1" and "−2", respectively. In this case, the equations (8) to (11) can be expressed as below.

$$(Vp_a2)eff=-1 \quad (11)$$

$$(Vp_b2)eff=-2 \quad (12)$$

$$(Vp_c2)eff=1 \quad (13)$$

$$(Vp_d2)eff=-2 \quad (14)$$

Next, an order of writing in the n+1th frame will be described.

FIG. 21 is a view showing orders of selecting signal lines and polarities of video signals when the writing order in each group in the n+1th frame is the same as that of the nth frame of FIG. 12.

For example, as to the row a in a group of R1, G1, B1 and R2 lines, in the nth frame of FIG. 12, the signal lines of B1 line and R1 line are selected first in this order and the signal lines of G1 line and R2 line are selected later in this order. Meanwhile, the n+1th frame of FIG. 21 also has the same selection order.

Each of upper sides of FIGS. 22 to 29 shows voltage waveforms indicating potential behavior of each own signal line (selected signal line) and its adjacent signal line in the n+1th frame when the writing order in each group is set the same as that of the nth frame. Each of lower sides of FIGS. 22 to 29 shows voltage waveforms of respective pixels which are connected to the own signal line. The respective pixels are influenced by potential changes of the own signal line and the adjacent signal line during the retaining period.

FIG. 30 is a view showing orders of selecting signal lines and polarities of video signals when the selection order of the signal lines selected first in each group in the n+1th frame is changed and the selection order of the signal lines selected later is changed with respect to the nth frame of FIG. 12.

For example, as to the row a in the group of R1, G1, B1 and R2 lines, in the nth frame of FIG. 12, the signal lines of B1 line and R1 line are selected first in this order and the signal lines of G1 line and R2 line are selected later in this order. Meanwhile, in the n+1th frame of FIG. 30, the signal lines of R1 line and B1 line are selected first in this order and the signal lines R2 line and G1 line are selected later in this order.

Each of upper sides of FIGS. 31 to 38 shows voltage waveforms indicating potential behavior of each own signal line (selected signal line) and its adjacent signal line in the n+1th frame when the writing order in each group is changed from that of the nth frame as described above. Each of lower sides of FIGS. 31 to 38 shows voltage waveforms of respective pixels which are connected to the own signal line.

FIGS. 39(*a*) to 39(*c*) are views relatively showing effective potentials of respective pixels in a comparative example. FIG. 39(*a*) shows values obtained by relatively defining the effective potentials of the respective pixels, which are obtained by use of FIGS. 13 to 20, as to the nth frame. FIG. 39(*b*) shows values obtained by relatively defining the effective potentials of the respective pixels, which are obtained by use of FIGS. 22 to 29, in the n+1th frame when the writing order is set the same as that of the nth frame. FIG. 39(*c*) shows average effective potentials of every pixel in the nth frame and the n+1th frame. Note that, FIGS. 39(*a*) to 39(*c*) are views when Green raster display is assumed.

When G1 line to G8 line in FIG. 39(*c*) are observed in a signal line direction, it is found out that only G3 line and G7 line are formed of only relative effective potentials "0" and "−2" and the two lines are different from the other lines in the effective potential. Moreover, when the entire display area is observed, it is found out that relative effective potentials "1" and "−1" are continuously and linearly arranged, respectively, in a direction from the upper right to the lower left.

As described above, when the nth frame and the n+1th frame have the same writing order, the both frames have the same arrangement of the relative effective potentials. Thus, the average effective potentials of G3 line and G7 line are different from those of the other lines. Furthermore, from a macroscopic viewpoint, the display area has linear inclinations of effective potentials in the direction from the upper right to the lower left thereof. Due to the inclinations described above, unevenness become visible easily on a display screen.

Meanwhile, FIGS. 40(*a*) to 40(*c*) are views relatively showing effective potentials of respective pixels in an example. FIG. 40(*a*) shows values obtained by relatively defining the effective potentials of the respective pixels, which are obtained by use of FIGS. 13 to 20, as to the nth frame. FIG. 40(*b*) shows values obtained by relatively defining the effective potentials of the respective pixels, which are obtained by use of FIGS. 31 to 38, when the writing order is changed between the nth frame and the n+1th frame. FIG. 40(*c*) shows average effective potentials in the nth frame and the n+1th frame. Note that, FIG. 40(*a*) to 40(*c*) are also the views when Green raster display is assumed, and FIG. 40(*a*) is the same view as FIG. 39 (*a*).

In FIGS. 40(*a*) to 40(*c*), when attention is focused on the pixel of the row a in G line, for example, while the relative effective potential is "−1" in the nth frame, the relative effective potential is "1" in the n+1th frame. Thus, the average effective potential is "0".

As described above, in all the pixels, unbalance of the effective potentials in the nth frame is canceled by changing the writing order in the n+1th frame. Accordingly, average balance can be achieved.

As a result, as shown in FIG. 40(*c*), the average effective potentials in the respective pixels are in a state where "0" and "−2"s are arranged regularly in a checked pattern on the entire screen. Thus, unevenness is hard to be visible. Moreover, by optimizing the coupling capacities Cp1, Cp2 and Cp3, it is also possible to optimize the effective potential difference of the pixels, which is indicated by "0" and "−2".

Therefore, according to this embodiment, by changing the selection order of the signal lines to be selected first in each group and changing the selection order of the signal lines to be selected later between the nth frame and the n+1th frame, average balance of the effective potentials in the respective pixels can be achieved between the nth frame and the n+1th frame. Consequently, the average effective potentials when viewed as the entire screen are in a state of being regularly arranged. Thus, it is possible to make unevenness hard to be visible.

Note that, in this embodiment, the writing order is changed for each frame between the nth frame and the n+1th frame. However, the writing order is not limited thereto. For example, the writing order may be changed for every two frames. In this case, effects similar to those described above can be also obtained.

Based on the above, in the case of driving by dividing one video output line into a plurality of (N) signal lines, the most preferred method for writing analog signals in consideration of influence of write deficiency and coupling capacities includes the following conditions.

(1) To control the selection order, in each group, so as to select first a signal line to which a video signal having its polarity inverted between the L−1th line and the Lth line is supplied and select later a signal line to which a video signal having its polarity not inverted is supplied, in order not to be influenced by coupling capacities with adjacent signal lines in a floating state in which no own signal line is selected during N signal line selection periods in one horizontal scan period.

(2) To control the selection order of signal lines to be selected first in each group as well as the selection order of signal lines to be selected later in such a manner that write conditions are distributed evenly across the entire display screen, the write conditions being related to presence of polarity inversion of a video signal between the L−1th line and the Lth line in each pixel within one horizontal scan period and presence of polarity inversion of a video signal between the S−1th line and the Sth line in selecting the signal lines.

(3) To change the selection order of signal lines to be selected first in each group as well as the selection order of signal lines to be selected later for each of frames with a fixed interval therebetween so as to spatially distribute potential changes of pixels due to influence of coupling capacities in a retaining period without being gathered on a specific line.

Particularly, by simultaneously satisfying the three conditions described above, a high-quality display device in which unevenness is hard to be visible can be realized.

Moreover, even in the case where a writing order other than those described above in the respective embodiments is adopted or the case where the number of signal lines in one group is set at the number other than N=4, similar effects can be obtained by satisfying the three conditions described above.

What is claimed is:

1. A liquid crystal display device comprising:

a pixel display including pixels at respective intersections of a plurality of scan lines and a plurality of signal lines;

drive ICs configured to supply video signals through video output lines, each video output line corresponding to a group of N signal lines, where N is an integer not less than 3;

switching circuits, each of which connects a signal line selected from the group of N signal lines to a corresponding video output line for each group, wherein a first signal line in the group of N signal lines to which a video signal having its polarity inverted between an L-1th scan line (L is an integer not less than 2) and an Lth scan line, and a second signal line in the group of N signal lines to which a video signal having its polarity not inverted between an L-1th scan line and an Lth scan line are supplied, the first signal line having its polarity inverted between the L-1th scan line and the Lth scan line alternating with the second signal line having its polarity not inverted between the L-1th scan line and the Lth scan line; and a control circuit configured to select first the first signal line to which the video signal having its polarity inverted between the L-1th scan line and the Lth scan line is supplied and to select second the second signal line to which the video signal having its polarity not inverted is supplied, for each of the groups in writing video signals into respective pixels in the Lth scan line via the signal lines.

2. The liquid crystal display device according to claim 1, wherein the control circuit controls a selection order of a plurality of signal lines to be selected first in each group as well as a selection order of a plurality of signal lines to be selected later in such a manner that write conditions of the respective pixels are distributed evenly across an entire display screen, the write conditions being related to presence of polarity inversion of a video signal between the L-1th line and the Lth line as to each of the signal lines and presence of polarity inversion of a video signal between a signal line selected to be an S-1th (S is an integer not less than 1) and a signal line selected to be an Sth.

3. The liquid crystal display device according to claim 1, wherein the control circuit change the selection order of signal lines selected first in each group as well as the selection order of signal lines selected later, for each of frames with a fixed interval therebetween.

* * * * *